US009067716B2

(12) United States Patent
Cronin et al.

(10) Patent No.: US 9,067,716 B2
(45) Date of Patent: Jun. 30, 2015

(54) CAP ASSEMBLY FOR DISPENSING A DISPENSABLE COMPONENT AND METHOD OF MAKING AND USING THE SAME

(75) Inventors: Jerry Cronin, Waltham, MA (US); Vlad Moise, Marietta, GA (US); Mike Burgess, Tulbagh (ZA); Russell J. Kroll, Altanta, GA (US)

(73) Assignees: Federico Intriago, Miami, FL (US); VIZ Enterprises, LLC, Miami, FL (US)

( * ) Notice: Subject to any disclaimer, the term of this patent is extended or adjusted under 35 U.S.C. 154(b) by 721 days.

(21) Appl. No.: 13/249,987

(22) Filed: Sep. 30, 2011

(65) Prior Publication Data

US 2013/0082022 A1 Apr. 4, 2013

(51) Int. Cl.
*B65D 51/18* (2006.01)
*B65D 51/28* (2006.01)

(52) U.S. Cl.
CPC ..... *B65D 51/2864* (2013.01); *Y10T 29/49826* (2015.01); *B65D 51/18* (2013.01)

(58) Field of Classification Search
CPC ..... B65D 51/2864; B65D 51/18; Y10T 29/49826
USPC ..... 220/255, 255.1, 258.1, 258.3, 265, 712; 206/219, 222; 215/DIG. 8, 254, 250; 222/129, 81, 83; 53/420, 412, 422
See application file for complete search history.

(56) References Cited

U.S. PATENT DOCUMENTS

| | | | |
|---|---|---|---|
| 179,461 | A | 7/1876 | Portemonnaies |
| 3,279,654 | A | 10/1966 | Pierick |
| 3,599,845 | A | 8/1971 | Miller |
| 3,924,741 | A | 12/1975 | Kachur et al. |
| 4,024,952 | A | 5/1977 | Leitz |
| 4,253,588 | A | 3/1981 | Lester et al. |
| 4,315,570 | A | 2/1982 | Silver et al. |
| 4,865,189 | A | 9/1989 | Guerra et al. |
| 4,947,986 | A | 8/1990 | Ballu |
| 4,982,875 | A | 1/1991 | Pozzi et al. |
| 5,217,433 | A | 6/1993 | Bunin |
| 5,255,812 | A | 10/1993 | Hsu |

(Continued)

FOREIGN PATENT DOCUMENTS

| | | |
|---|---|---|
| DE | 3622773 | 1/1988 |
| DE | 296 20 767 | 2/1998 |

(Continued)

OTHER PUBLICATIONS

Non-final Office Action dated Mar. 9, 2012 and issued in copending U.S. Appl. No. 12/942,443.

(Continued)

*Primary Examiner* — Robert J Hicks
*Assistant Examiner* — Kareen Rush

(57) ABSTRACT

Cap can include a cap body mountable to a container. A main bore is disposed in the cap body. A movable component holder can include a lower end, an upper end, and a space sized and configured to contain a dispensable component. A cover is installable on the upper end of the component holder. A removable strip is at least one of arranged between a portion of the upper end of the component holder and an upper surface of the cap body, has an upper end removably connected to a portion of the upper end of the component holder, has a lower end contacting or arranged adjacent a portion of the cap body, and integrally formed with the upper end of the component holder.

30 Claims, 18 Drawing Sheets

(56) References Cited

U.S. PATENT DOCUMENTS

| | | | |
|---|---|---|---|
| 5,255,813 | A | 10/1993 | Berggren et al. |
| 5,277,303 | A | 1/1994 | Goyet et al. |
| 5,337,931 | A | 8/1994 | Kitterman |
| 5,388,690 | A | 2/1995 | Mutterle et al. |
| 5,419,445 | A | 5/1995 | Kaesemeyer |
| 5,794,802 | A | 8/1998 | Caola |
| 5,863,126 | A | 1/1999 | Guild |
| 5,908,107 | A | 6/1999 | Baudin |
| 5,927,549 | A | 7/1999 | Wood |
| 5,950,819 | A | 9/1999 | Sellars |
| 5,967,309 | A | 10/1999 | Robles-Gonzalez et al. |
| 6,003,728 | A | 12/1999 | Elliott |
| 6,098,795 | A | 8/2000 | Mollstam et al. |
| 6,105,760 | A | 8/2000 | Mollstam et al. |
| 6,148,996 | A | 11/2000 | Morini |
| 6,149,866 | A | 11/2000 | Luotola et al. |
| 6,152,296 | A | 11/2000 | Shih |
| 6,209,718 | B1 | 4/2001 | Mollstam et al. |
| 6,230,884 | B1 | 5/2001 | Coory |
| 6,257,428 | B1 | 7/2001 | Caola |
| 6,257,453 | B1 | 7/2001 | Graham |
| 6,257,463 | B1 | 7/2001 | DePolo |
| 6,375,041 | B1 | 4/2002 | Klima et al. |
| 6,387,073 | B1 | 5/2002 | Weiler et al. |
| 6,435,341 | B1 | 8/2002 | Nobbio |
| 6,513,650 | B2 | 2/2003 | Mollstam et al. |
| RE38,067 | E | 4/2003 | Gueret |
| 6,609,634 | B2 | 8/2003 | DeLaforcade et al. |
| 6,644,471 | B1 | 11/2003 | Anderson |
| 6,679,375 | B1 | 1/2004 | Coory |
| 6,705,490 | B1 | 3/2004 | Lizerbram et al. |
| 6,705,491 | B1 | 3/2004 | Lizerbram et al. |
| 6,763,939 | B2 | 7/2004 | Alticosalian |
| 6,772,910 | B1 | 8/2004 | Coory |
| 6,854,595 | B2 | 2/2005 | Kiser |
| 6,886,686 | B2 | 5/2005 | Anderson |
| 6,921,087 | B2 | 7/2005 | Takahashi et al. |
| 6,926,138 | B1 | 8/2005 | Basham et al. |
| 7,032,745 | B2 | 4/2006 | Saulle |
| 7,055,684 | B2 | 6/2006 | Anderson |
| 7,172,095 | B2 | 2/2007 | Marshall |
| 7,249,690 | B2 | 7/2007 | Smith et al. |
| 7,503,453 | B2 | 3/2009 | Cronin et al. |
| 7,854,104 | B2 | 12/2010 | Cronin et al. |
| 2002/0030056 | A1 | 3/2002 | Hsu |
| 2002/0040856 | A1 | 4/2002 | Mollstam et al. |
| 2003/0072850 | A1 | 4/2003 | Burniski |
| 2003/0213709 | A1 | 11/2003 | Gibler et al. |
| 2004/0112770 | A1 | 6/2004 | Oswald |
| 2004/0159562 | A1 | 8/2004 | Takahashi et al. |
| 2004/0200740 | A1 | 10/2004 | Cho |
| 2004/0200741 | A1 | 10/2004 | Cho |
| 2004/0208960 | A1 | 10/2004 | Marshall |
| 2005/0115845 | A1 | 6/2005 | Cho |
| 2005/0173271 | A1 | 8/2005 | Levi |
| 2005/0236424 | A1 | 10/2005 | Walters et al. |
| 2006/0006077 | A1 | 1/2006 | Mosher et al. |
| 2006/0118435 | A1* | 6/2006 | Cronin et al. ..... 206/219 |

FOREIGN PATENT DOCUMENTS

| | | |
|---|---|---|
| EP | A-377412 | 1/1989 |
| JP | 2000-062788 | 2/2000 |
| WO | WO 2005/120977 | 12/2005 |

OTHER PUBLICATIONS

Instant Mixer Cap—The Revolutionary Instant Drink Dispensing System, downloaded from various locations indicated on pages from http://www.instantmixercap.com on Dec. 11, 2007 and Jan. 6, 2008, 6 pages.

Liquid Health Labs, Inc.—building a brand with a twist, downloaded from http://www.liquidhealthlabs.com/NAVIGATION/technology.html, on Dec. 11, 2007, 1 page.

BevNET.com Classified Ad—POWERCAP—Dosing System for Enhanced Beverages, downloaded from http://www.bevnet.com/classifieds/ad/6B76A1A0A9304EF0890F8389C0F05B15 on Dec. 11, 2007, 1 page.

Erie Plastics, Pop N' Shake downloaded from http://www.erieplastics.com/programs_details.php?program_page=2 on Jan. 21, 2008, 2 pages.

Pop N' Shake™ Refresh, Replenish, Reinvigorate, White Paper downloaded from http://www.erieplastics.com/cms/uploads/tradetools/PopNShakeWhitePaper2-2.pdf, on Dec. 11, 2007, 5 pages.

Pop N' Shake Video page downloaded from http://www.erieplastics.com/popnshake on Jan. 21, 2008, 1 page.

Tabnology—the link between Health and Convenience, SwissCo Pharma & Food Supplements, downloaded from http://www.swissco.ch/index.php?id=20&L=0&L=1 on Jan. 6, 2008, 1 page.

Ikon the Ultimate innovation to increase your drink market share, tabnology europe, downloaded from http://www.swissco.ch/fileadmin/inhalte/dokumente/IkonPresentation_e.pdf on Jan. 6, 2008, 13 pages.

Freshmix Cap Systems System Outline, 9 pages, date unknown.

"PowerCap", downloaded from the website http://mypowercap.com on May 14, 2010, 2 pages total.

"Last Shot Drink", downloaded from the website http://lastshotdrink.com and websites accessible therefrom on May 14, 2010, 7 pages total.

Machine Translation of JP 2000-062788.

* cited by examiner

SECTION A - A

SECTION B-B

Fig. 15
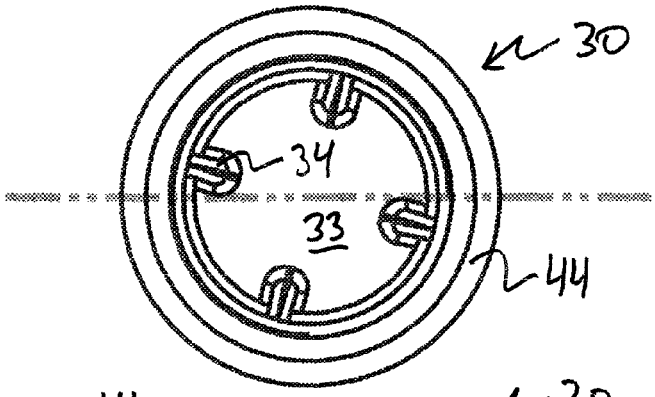
Fig. 16
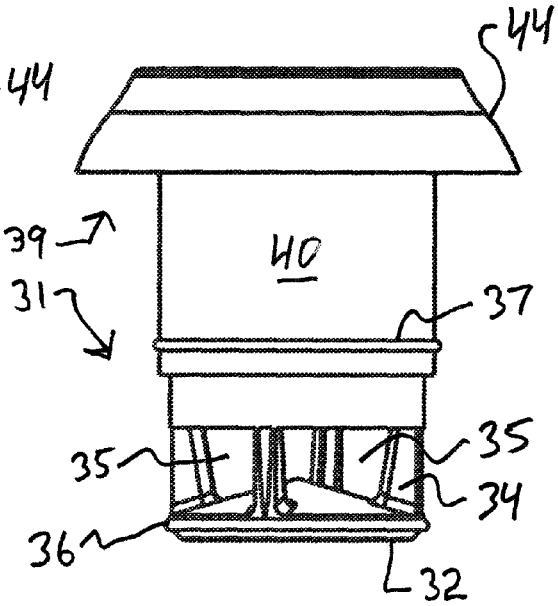
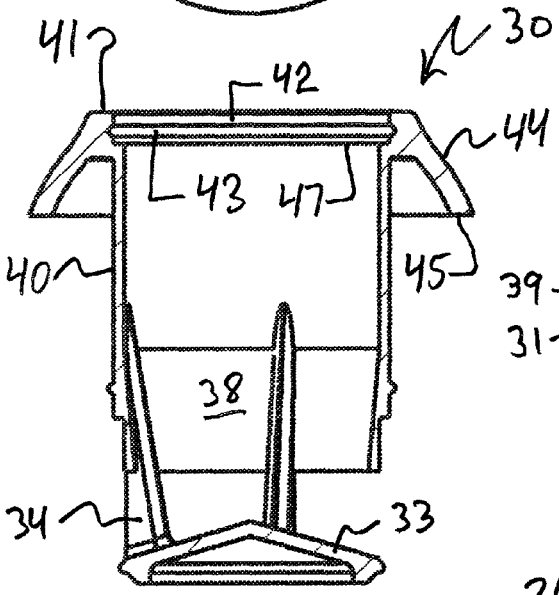
Fig. 17
30

CAP ASSEMBLY FOR DISPENSING A DISPENSABLE COMPONENT AND METHOD OF MAKING AND USING THE SAME

BACKGROUND OF THE INVENTION

1. Field of the Invention

The invention relates to a cap, cap assembly or a dispensing or dosing closure adapted to be installed on a container and which can contain therein or accommodate at least one dispensable component such as e.g., a powder or tablets. With such a cap, the dispensable component can be kept or maintained separate from one or more components in a container even while installed thereon. Additionally, the cap can also be activated or placed in a dispensing position so that the dispensable component is caused to pass from within the cap into the container and thereby, e.g., mix with the component(s) in the container.

2. Discussion of Background Information

Many different styles of caps, lids and closures have been well documented and described in the prior art. They include tamper evident closures, caps that seal the container using a check valve taking advantage of the squeeze action of a flexible bottle to create the pressure differential to activate the valve, and other devices. Also prior art concerning containers with two compartments, separating two ingredients to be mixed before consumption, exist; but few if any of these containers are commercially available mostly because of complicated parts, difficulty of filling and high manufacturing cost.

Many of these devices consist of a piercing tip or cutter that perforates or cuts a foil seal, blister pack or membrane releasing one component into a supplemental component, usually tablets, granules or powders into a liquid. Minor differences, consisting mostly of how the piercing tip is activated, differentiate these devices. Whether piercing tips or cutters are used to remove the seal between compartments, there is always the danger of having fragments of foil or other residue fall into the mixed components.

Caps have been disclosed which overcome many of the above-noted disadvantageous. For example, U.S. Pat. No. 7,503,453 to CRONIN et al. discloses various cap embodiments which can dispense a dispensable component into a container. FIGS. 1-5 of the instant application show one embodiment of CRONIN (see FIGS. 8-13 of CRONIN). As can be seen in FIGS. 1-5, the cap C is installed on a neck opening 102 of a container 100. The container 100 has a body or wall 101 and can include a collar 103. As can be seen from comparing FIGS. 1 and 2 with FIGS. 3 and 4, when a user desires to dispense the dispensable component from within the cap C into the container 100, the user need only remove the tear strip TS and move the dome-shaped upper end of the cap C towards the container 100. This allows the dispensable component to pass out of the cap C into the container 100 (not shown, but see FIG. 13 of CRONIN). The entire disclosure of U.S. Pat. No. 7,503,453 to CRONIN et al. is hereby expressly incorporated by reference.

This invention provides a cap or cap and container that can overcome one or more, and preferably many, of the disadvantages of the prior art while providing a cap or cap and container that is easy to use, uses a minimum number of parts, and that is simple to manufacture and assemble.

SUMMARY OF THE INVENTION

According to one non-limiting aspect of the invention, there is provided a cap comprising a cap body mountable to a container and a main bore disposed in the cap body. A movable component holder comprises a lower end, an upper end, and a space sized and configured to contain a dispensable component. A cover is installable on the upper end of the component holder. A removable strip at least one of is arranged between a portion of the upper end of the component holder and an upper surface of the cap body, has an upper end removably connected to a portion of the upper end of the component holder, has a lower end contacting or arranged adjacent a portion of the cap body, and/or is integrally formed with the upper end of the component holder. When the component holder is in an initial or retracted position, a portion of each of the cap body, the component holder, and the cover is adapted to come into contact with the dispensable component. Also, when the cap is arranged on the container and the component holder is arranged in a dispensing position, the dispensable component can pass into the container through a portion of the component holder disposed between the lower end and a portion of the cap body.

In embodiments, the cover at least one of; is non-removably connected to the upper end of the component holder, closes off an opening in the upper end which allows the dispensable component to pass into the space, and/or is generally dome-shaped.

In embodiments, the cap may further comprises a first seal arranged in an area of the lower end of the component holder and being in a sealing position when the component holder is in the initial or retracted position and a second seal arranged on the component holder and being axially spaced from the first seal.

In embodiments, the first and second seals are in sealing engagement with different portions of the cap body when the component holder is in the initial or retracted position.

In embodiments, the second seal is in a locking engagement when the component holder is in the dispensing position.

In embodiments, the component holder and the removable strip are formed as a one-piece member.

In embodiments, the cap body at least one of is a one-piece member and the cover is a one-piece member, and/or has an axial length that is shorter than a diameter of an outer most surface and the cover is generally dome-shaped.

In embodiments, the removable strip at least one of is a tear strip, prevents movement of the component holder from the initial or retracted position to the dispending position until the removable strip is removed, and/or is a generally cylindrical strip-shaped member having a pull-tab and being connected with a frangible or breakable connection to the upper end of the component holder.

In embodiments, the lower end comprises one of a tapered bottom, a conical shaped bottom wall, and a bottom wall having a shape configured to facilitate a flowing out of the dispensable component when the component holder is arranged in the dispensing position.

In embodiments, the cap may further comprise at least one of; legs or a leg connecting a bottom wall to a main body portion of the component holder, openings disposed between legs or a leg allowing the dispensable component to pass out of the space, and openings and legs or a leg axially arranged between first and second axially spaced seals of the component holder.

In embodiments, the original or retracted position is a releasably lockable storage position and the dispensing position is a lockable activated position.

In embodiments, the cover is at least one of structured and arranged to receive a desiccant, press fit attached to the upper end of the component holder, and in sealing engagement with the upper end of the component holder.

In embodiments, in the dispensing position, the cap body, the component holder and the cover comprise an integral unit.

In embodiments, the main bore of the cap body is defined by a generally cylindrical inner wall, and the cap body further comprises at least one of an outer wall surrounding the inner wall and having an internal thread or thread segments arranged on an inner surface of the outer wall and a tamper-evident ring connected to the cap body.

In embodiments, the upper end comprises one of a center opening sized to receive therein the cover, an outermost diameter that is larger than a diameter of an inner wall of the cap body and smaller than a diameter of an outer wall of the cap body, a generally dome-shaped annular portion of the component holder, a lower surface axially spaced above an upper surface of the cap body when the component holder is in the initial or retracted position, and a lower surface axially arranged adjacent an upper surface of the cap body when the component holder is in the dispensing position.

In embodiments, the space is at least one of a generally cylindrical space, axially disposed between the cover and the lower end of the component holder, and sized and configured to contain a predetermined amount of dispensable component and a predetermined amount of gas or air.

In embodiments, there is provided a method of assembling the cap of any of the types described herein wherein the method comprises inserting the component holder, lower end first, into the main bore of the cap body, after the inserting, placing a measured amount of the dispensable component into the space, and attaching the cover to the upper end of the component holder.

In embodiments, the method further comprises mounting, screwing or threading the cap onto a container until a tamper evident ring locks behind a collar of the container.

In embodiments, there is provided, in combination, the cap having one or more features disclosed herein and at least one of a container, a single wall container, and a container contains a component different from the dispensable component.

In embodiments, the cap having one or more features disclosed herein contains therein a dispensable component.

In embodiments, there is provided a method of using the cap of any of the types described herein, wherein the method comprises removing the removable strip with the cap installed on a container and applying a force to the upper end of the component holder sufficient to cause the component holder to move from the initial or retracted position to the dispensing position. In the dispensing position, at least one of; substantially all of the dispensable component passes into the container, substantially all of the dispensable component automatically passes into the container, and substantially all of the dispensable component passes into the container under the influence of gravity.

According to one non-limiting aspect of the invention, there is provided a cap comprising a cap body mountable to a container and comprising a bore. A component holder comprises an upper portion, an internal space for accommodating a dispensable component, a lower portion, and a bottom wall. The lower portion is positionable inside the bore and comprises first and second axially spaced seals and at least one opening arranged between the first and second axially spaced seals. The upper portion comprises at least a partially dome-shaped surface and an opening allowing the dispensable component to enter into the space. A removable tear strip at least one of being structured and arranged to prevent the component holder from moving downward relative to the cap body until the tear strip is removed and providing a compression barrier against activation of the cap. In a storage position, a portion of each of the cap body and the component holder is adapted to come into contact with a dispensable component. Also, when the cap is arranged on the container and the component holder is moved to an activated position, the dispensable component can pass into the container through the at least one opening formed in the lower portion of the component holder.

In embodiments, the cap may further comprise a cover sized to close off the opening of the upper portion, wherein the internal space is arranged between the bottom wall and the cover.

In embodiments, the internal space may be a generally cylindrical internal space.

In embodiments, at least one of; in the activated or dispensing position, the second seal is separated from a lower end of an inner wall of the cap body and the first seal is in locking engagement with a locking seal arranged on the inner wall and in the storage position, the second seal is in sealing engagement with a lower portion of an inner wall of the cap body and the first seal is in sealing engagement with an upper portion of the inner wall\.

In embodiments, the cap further comprises a cover having a generally dome-shaped outer surface.

In embodiments, the storage position is a lockable storage position and the activated position is a lockable activated position.

In embodiments, the cap may further comprise at least one of struts arranged on the lower end of the component holder between the first and second seals and the at least one opening comprises apertures disposed between struts.

According to one non-limiting aspect of the invention, there is provided a cap comprising a cap body mountable to a container and comprising a bore. A movable component holder comprises a lower end, an upper end, a space sized to contain a dispensable component, and an axial length greater than an axial length of the cap body. First and second axially spaced seals are arranged on the component holder. The first seal is arranged on the lower end of the component holder and is in sealing engagement with a first portion of an inner wall of the cap body. The second seal is arranged on the lower end of the component holder and is in sealing engagement with a second axially lower portion of the inner wall of the cap body. A generally dome-shaped cover is in sealing engagement with a portion of the upper end of the component holder. When the component holder is in an original or retracted position, a portion of each of the cap body, the component holder, and the cover is adapted to come into contact with the dispensable component. Also, when the cap is arranged on the container and the component holder is in a dispensing position, the dispensable component can pass into the container through a portion of the component holder disposed between the first and second seals.

In embodiments, the cap may further comprise at least one of a sipper arranged on the upper end of the component holder, a nozzle or sipper coupled to the cover, and a cover comprising a nozzle or sipper portion.

In embodiments, each of the individual members shown in the drawings and or described herein, i.e., the cap body, the component holder, or the cover, can constitute a separate invention with or without one or more of the other members or features shown or described herein.

In embodiments, the cap or cap assembly may be of a standard size such as 20 mm, 38 mm or 43 mm.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIGS. 1 and 2 show the cap in an original, initial or storage position and FIGS. 3 and 4 show the cap in an activated or dispensing position.

FIG. 5 shows the cap before it is threaded onto the container;

FIGS. 15-17 show top, side and cross-section views of the component holder used in the cap shown in FIG. 6. For purposes of clarity, the tear strip has been removed and is not shown;

DETAILED DESCRIPTION OF THE INVENTION

Figure 6:
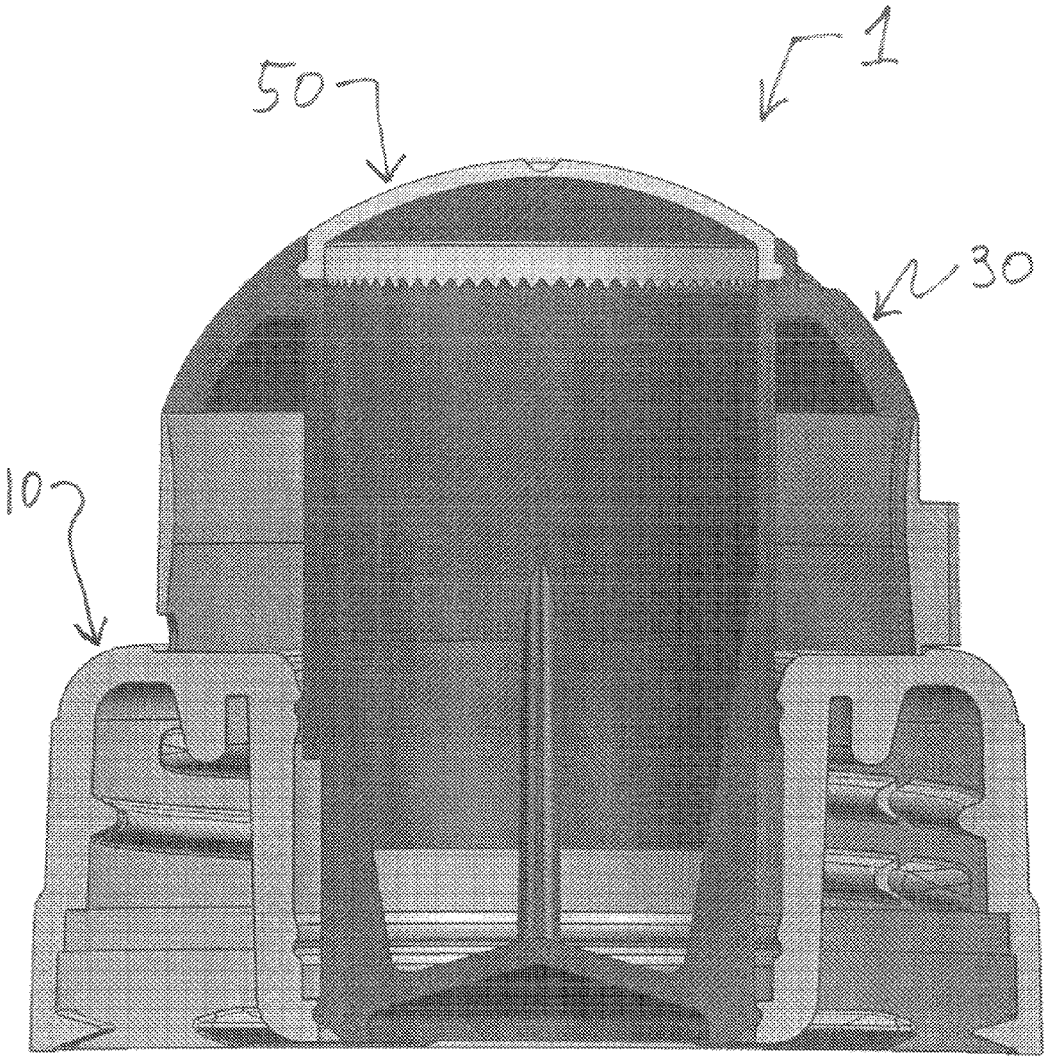
FIG. 6 shows an enlarged solid-shading cross-section of a cap or cap assembly in a fully assembled state in accordance with the invention. For clarity purposes, the dispensable component is not shown arranged within the component holder.

With reference to FIGS. 6-18, there is shown a first non-limiting embodiment of a cap or cap assembly 1. As can be seen in FIG. 6, in embodiments, the cap 1 can include three main components, i.e., a cap body 10, a component holder 30, and a cover 50. The cap body 10 installable or mountable to a container such a container 100 shown in FIGS. 1-4. Of course, containers of other types, sizes and shapes can be used with the cap 1 in accordance with the invention.

Figure 5:
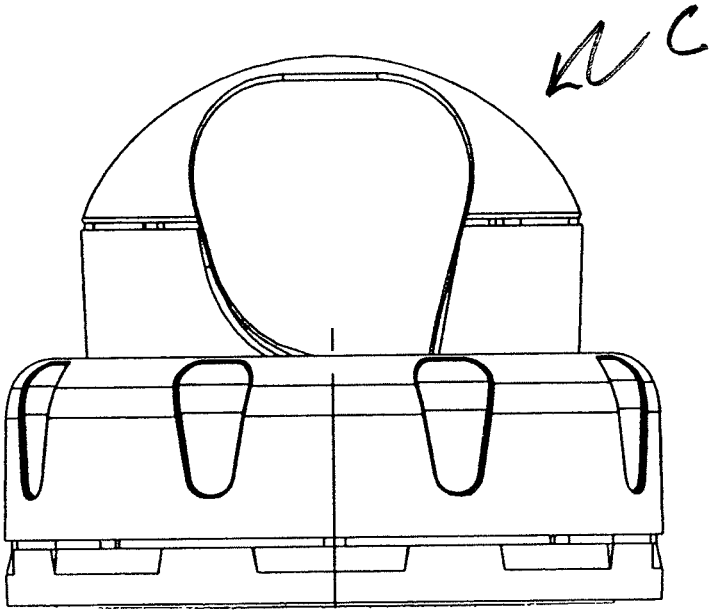
Figure 11:
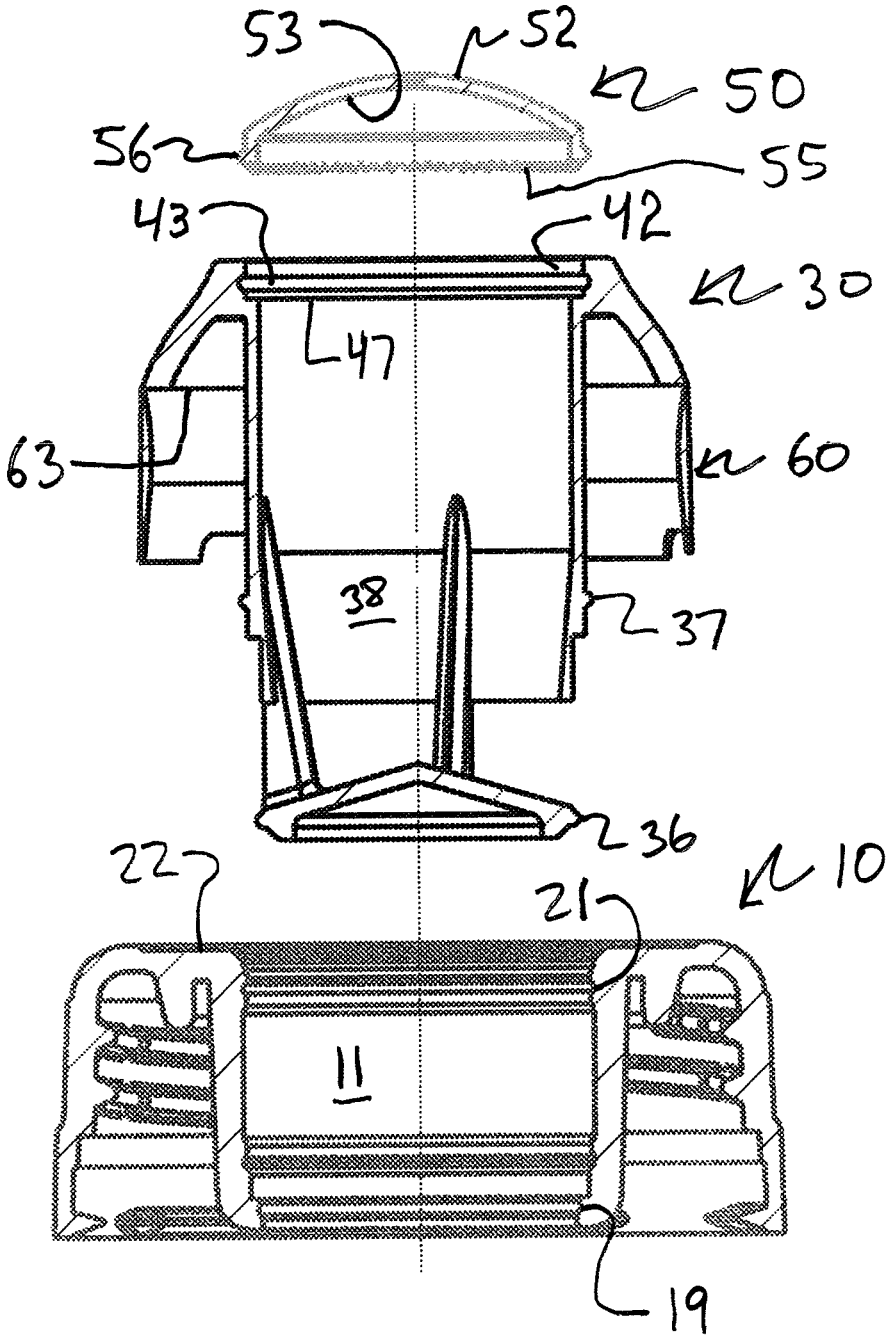

As is the case with the cap C shown in FIG. 5, the cap 1 of FIG. 6 is sized and configured to contained therein one or more dispensable components (in a manner similar to that shown in FIG. 11 of U.S. Pat. No. 7,503,453 to CRONIN, the disclosure of which is incorporated by reference). In embodiments, the dispensable component(s) can be of any type that can be stored in a cap of the type disclosed herein. By way of non-limiting example, the dispensable component(s) can be of any type disclosed U.S. Pat. No. 7,503,453 to CRONIN, the disclosure of which is incorporated by reference. Moreover, a container, e.g., container 100, usable with the cap 1 can include any substance(s) and/or component(s) that can be stored in a container of the type disclosed herein. By way of non-limiting example, the substance(s) and/or component(s) can be of any type disclosed U.S. Pat. No. 7,503,453 to CRONIN, the disclosure of which is incorporated by reference. Non-limiting examples of herein discussed dispensable component(s) as well as the substance(s) and/or component(s) that can be stored in a container are described below.

As will be described in detail later on with respect to FIGS. 22-27, the dispensable component(s) can be stored in the cap 1 until it is desired that they be dispensed into the container. Furthermore, as will be described in detail later on with reference to FIGS. 19-21, the cap 1 in accordance with the invention can be almost fully assembled (and optionally even installed onto a container) before it receives therein the dispensable component(s). That is, the cover 50 can be installed on the cap 1 after the dispensable component(s) is placed within the cap 1 and/or after the sub-assembled cap 1 is installed on a container.

Figure 7:
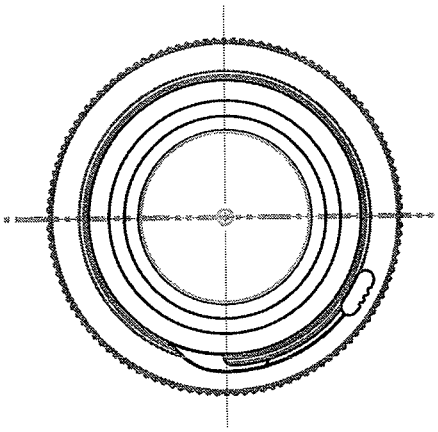
FIGS. 7-9 show top, side and cross-section views of the cap shown in FIG. 6.
Figure 8:
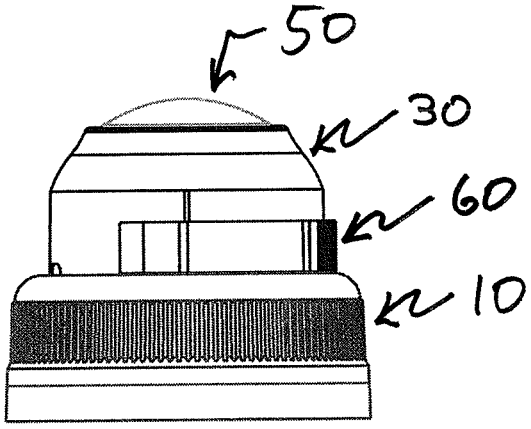
Figure 9:
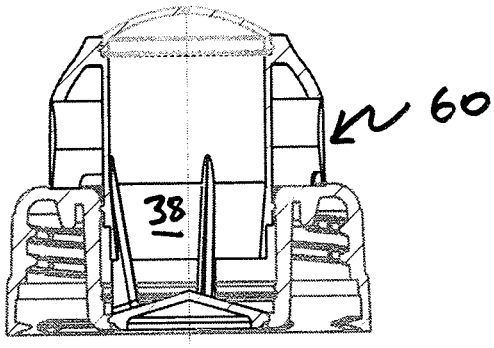

With reference to FIGS. 7-9, it can be seen that the cap 1 can be assembled into a single or self-contained unit. The unit is essentially complete once the dispensable component(s) is placed inside the cap 1 and the cover 50 is installed thereon. Moreover, the cap 1 shown in FIGS. 7-9 can be handled in a manner which has one or more of the following advantageous: first, it can be packaged as a unit; second, it can be manipulated (e.g., rotated, shaken, turned up-side-down, etc.,) in the form shown without concern that the dispensable component(s) will spill out of the cap 1; third, the cap 1 seals in the dispensable component(s) so that it is not substantially contaminated with any outside substances; fourth, the cap 1 ensures that the dispensable component(s) remain separated from any substance or component in a container until it is activated; fifth, the cap 1 can include a mechanism that prevents inadvertent or accidental activation, i.e., it can include a mechanical device which prevents accidental dispensing of the dispensable component(s); sixth, the cap 1 can include a mechanism can provide an audible signal to a user indicating that the cap 1 is locked in an activated position; seventh, the cap 1 can require two specific or distinct steps to cause activation of the cap 1, i.e., first a user must remove a mechanical device and then the user must apply a force sufficient to activate the cap 1; eighth, by forming a component holder and a tear strip into an integral unit, the resulting cap 1 can be formed of only three main components which can each be one-piece synthetic resin members. This may reduce manufacturing and/or assembly costs; ninth, the cap 1 can be configured such that a portion of each main component 10, 30 and 50 is adapted to come into contact with the dispensable component(s), e.g., an inside surface 53 (see FIG. 11) of the cover 50, the portions 33, 34 and 40 (see FIGS. 15-17) of the component holder 30, and portions of an inner circumferential surface of the inner wall 17 (see FIG. 12); tenth, the space 38 within the cap 1 sized and configured to accommodate, store, retain or receive therein the dispensable component(s) can be sufficient to accommodate any desired amount of each dispensable component(s) and also optionally include an air, gas or empty space; and eleventh, the cap 1 can be sized and configured so that the dispensable component(s) are substantially automatically dispensed into the container such as can occur when the container is substantially vertically arranged. Such automatic dispensing can occur based on one, more than one, or a combination of the following: the force of gravity acting on the dispensable component(s); openings 35 and legs 34 (see FIGS. 15-17) of certain number (e.g., four), size and configuration so as to reduce frictional forces and thereby allow the dispensable component(s) to flow out of the space 38 and into the container more easily or freely or with less friction; a transfer of some of the kinetic energy and/or momentum resulting from the force causing activation of the cap 1 to the dispensable component(s) so that it can be used to facilitate movement of the dispensable component(s) from the space 38 into the container. Other non-limiting advantageous or benefits will also be apparent from a discussion of the invention which follows.

Figure 10:
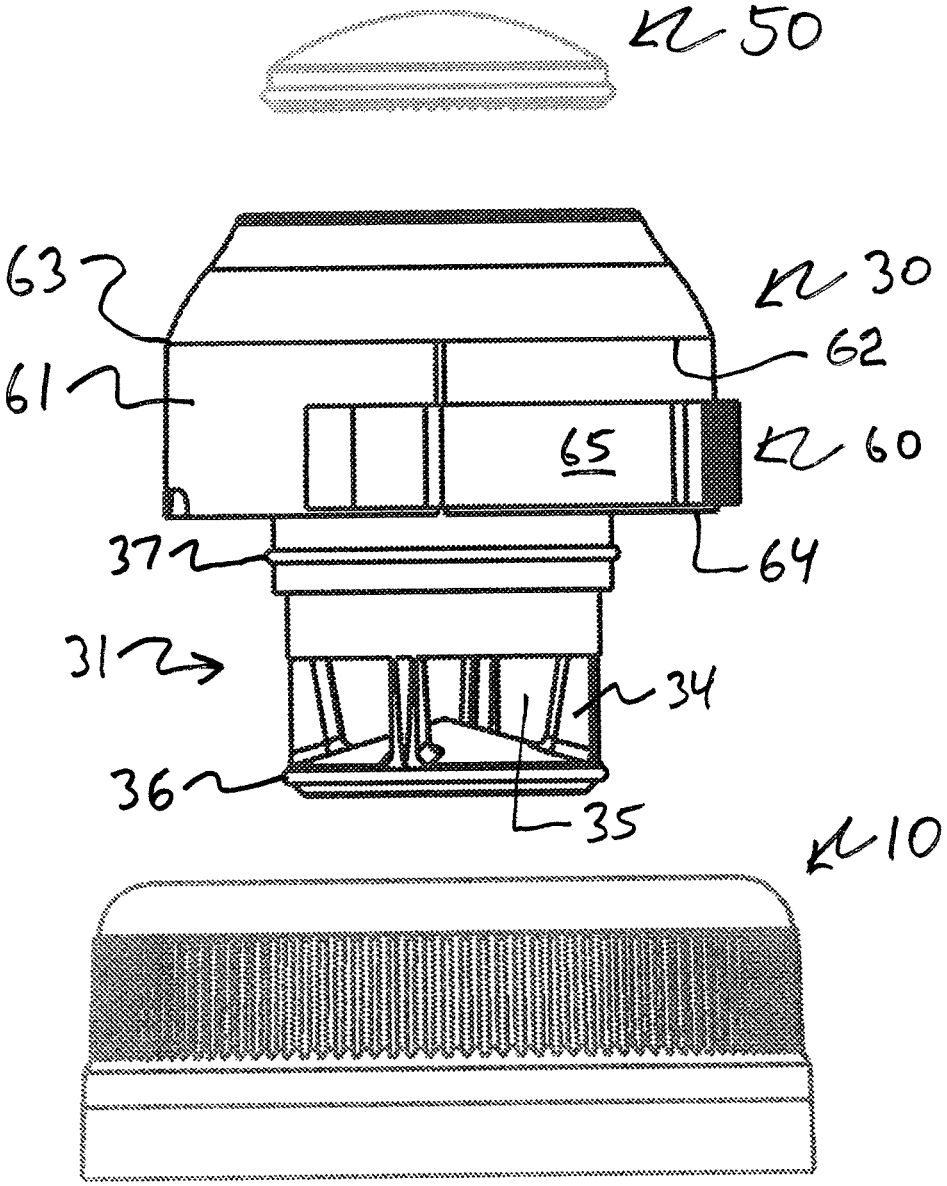
FIGS. 10 and 11 show side and cross-section views of the cap shown in FIG. 6 in a disassembled state.

With reference to FIGS. 10 and 11, it can be seen how the cap 1 can be assembled axially into a single or self-contained unit. With the cap body 10 positioned below or otherwise axially aligned with the component holder 10, the lower portion 31 can be inserted into the main bore or opening 11 of the cap body 10. The component holder 10 is fully or substantially inserted or assembled into the cap body 10 when the lower end 64 is arranged adjacent to or contacts surface 22 of the cap body 10 and also when lower sealing projection 36 is seated in the sealing recess 19 of the cap body 10 and when upper sealing projection 37 is seated in the sealing recess 21 of the cap body 10. Thereafter, a dispensable component(s) is inserted via the opening 42 and placed in the space 38. Next, the cover 50 is axially aligned over the opening 42 and inserted therein until the sealing projection 56 sealingly engages with the sealing recess 43 and the annular surface 55 engages with or contacts the shoulder 47. In embodiments, the configuration of the component holder 30 and cap body 10 is such that once assembled or connected to one another as just described, they cannot be disassembled without causing damage to one or more portions of these components. Similarly, in embodiments, the configuration of the component holder 30 and cover 50 is such that once assembled or connected to one another as just described, they cannot be disassembled without causing damage to one or more portions of these components. In one or both cases, the connections can be said to be non-removable and/or permanent. Moreover, in embodiments, the connection of the component holder 30 and the cover 50 can be reversed such that the cover 50 can include a recess and the component holder 30 can include a projection engaging therewith. Other connections can also be utilized such as adhesive bonding, ultrasonic welding, etc. Still further, in embodiments, the sealing engagement between the component holder 30 and the cap body 10 can be reversed such that the cap body 10 can include upper and lower projections (instead of recesses 19 and 21) and the component holder 30 can include upper and lower recesses (instead of projections 36 and 37). Still further, only one of the projections 36 and 37 can be replaced with a recess and only one of the recesses 19 and 21 can be replaced with a projection. Moreover, within the context of the invention, different sealing engagements (other than sealing projections and recesses) as well as more than two sealing projections or recesses can be utilized to provide sealing engagement between the component holder 30 and the cap body 10—provided the sealing engagement allows the cap 1 to store the dispensable component(s) and to dispense the same at a desired point in time as described above.

Figure 12:
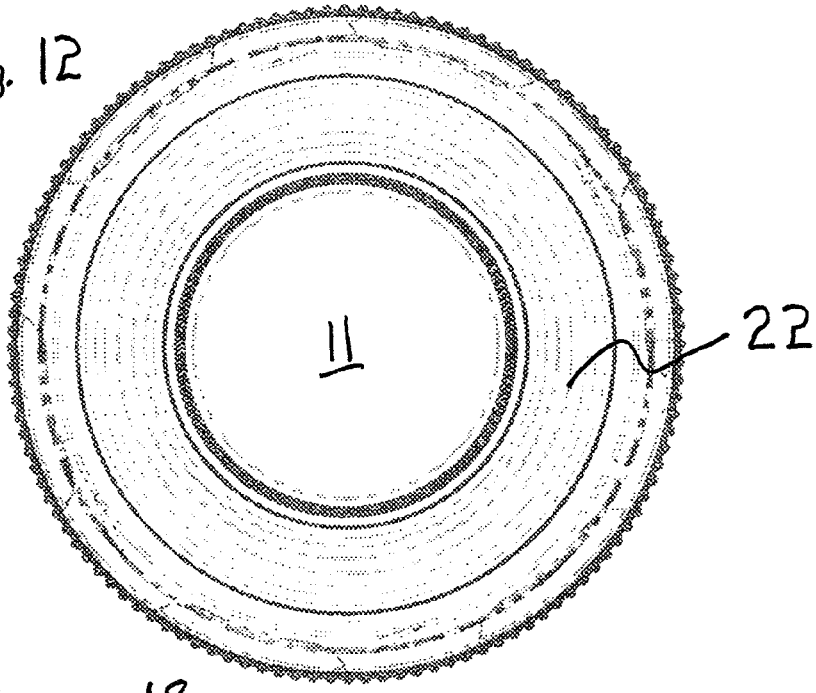
FIGS. 12-14 show top, side and cross-section views of the cap body used in the cap shown in FIG. 6.
Figure 13:
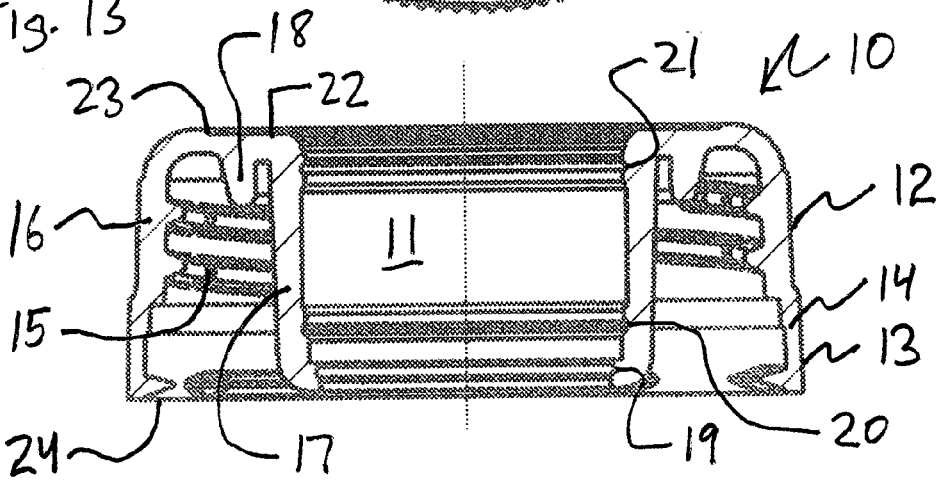
Figure 14:
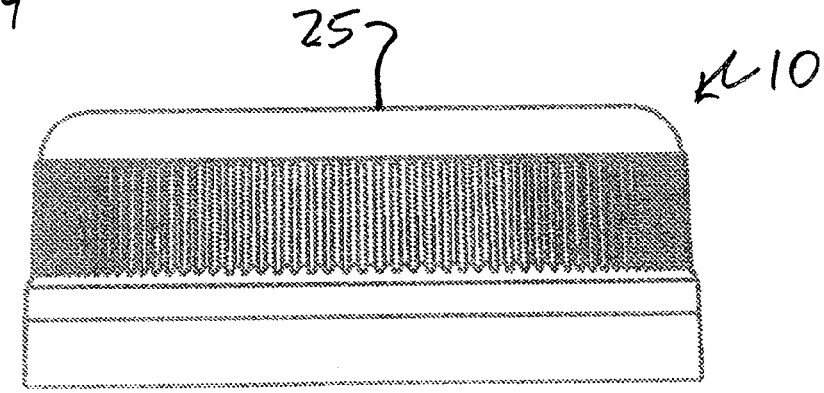

Referring now to FIGS. 12-14, it can be seen how the cap body 10 can be embodied. In embodiments, the cap body 10 is a one-piece integrally formed member having two main parts. One part is main cap portion 12 and another part is the tamper evident ring 13. The tamper evident ring 13 can be of any type conventionally known, but is preferably similar to that disclose in U.S. Pat. No. 7,503,453 to CRONIN et al. As is the case with conventional tamper evident rings, the tamper evident ring 13 has an internal thread and is connected via a frangible connection or breakable connection zone 14 to the main cap body 12. As regards the main cap portion 12, this member can include internal threads or thread segments 15 which can be of any type conventionally known, but is preferably similar to that disclose in U.S. Pat. No. 7,503,453 to CRONIN et al. These threads 15 are arranged on an inner circumferential surface of an outer wall 16 whose bottom annular edge is connected via connection 14 to the tamper evident ring 13. An inner wall 17 is arranged generally concentrically within the outer wall 16. The main opening 11 which receives therein the component holder 30 is defined by the inner wall 17. A downward projecting sealing wall 18 is arranged generally concentrically between the inner wall 17 and the outer wall 16. The size shape and configuration of the sealing wall 18 which can be of any type conventionally known, but is preferably similar to that disclose in U.S. Pat. No. 7,503,453 to CRONIN et al. A circumferential lower seal or sealing recess 19 is arranged on a lower end of the inner wall 17. As discussed above, the sealing recess 19 is sized, shaped and configured to sealingly engage with the lower sealing projection 36 of the component holder 30. A circumferential lower locking recess/projection 20 is also arranged on the inner wall 17. In embodiments, the locking recess 20 is arranged axially closer to the recess 19 than to the recess 21 as shown in FIG. 13. The locking recess 20 is sized, shaped and configured to lockingly engage with the upper sealing projection 37 of the component holder 30 when the component holder is moved to the dispensing position. In embodiments, this locking engagement produces a tactile and/or an audible signal so that a user will be aware that cap 1 has become locked in the dispensing position. Such engagement also ensures that the component holder 30 cannot be moved any further—thereby serving a device for limiting axial movement of the component holder 30. A circumferential upper seal or sealing recess 21 is arranged on an upper end of the inner wall 17. As discussed above, the sealing recess 121 is sized, shaped and configured to sealingly engage with the upper sealing projection 37 of the component holder 30. The cap body 10 also can include an upper annular surface 22 which, in embodiments, is axially spaced from an uppermost surface of the cap body 10. The surface 22 extends to a shoulder 23 whose size, shape and configuration is larger than an outer diameter of bottom end 64 of the treat strip 60. In this way, the end 64 can be positioned in contact with or adjacent to the surface 22 when the cap 1 is arranged in the storage position (see FIG. 6). An axial length of the cap body is defined by an axial distance between the lower end 24 and the upper end 25 of the cap body. In embodiments, this length is greater than an axial length of the cover 50 but less than that of the component holder 30.

Referring now to FIGS. 15-17, it can be seen how the component holder 30 can be embodied. In embodiments, the component holder 30 is a one-piece integrally formed member which, after being formed with a tear strip 60, has two main parts. One part is that shown in FIGS. 15-17 and another part is the tear strip 60 shown attached to this member in FIGS. 10 and 11. The tear strip 60 can be of any type conventionally known such as one that is similar to that disclose in U.S. Pat. No. 7,503,453 to CRONIN et al. In embodiments, however, it has the configuration shown in FIGS. 10 and 11, i.e., the tear strip 60 can include a main strip portion 61, an upper end 62 that is connected to the annular surface 45 via a breakable or frangible connection 63, a lower end 64 configured to contact, abut or be arranged adjacent to the surface 22 when the cap 1 is in the storage position, and a pull tab 65 which can be gripped by a user and which allows the user to remove the tear strip 60 and thereby break the frangible connection 63.

Referring back to FIGS. 15-17, it can be seen that the component holder 30 can include a lower portion or region 31 that is sized, shaped and configured to pass into the main opening 11 of the cap body 10. The component holder 30 also can include a lower end 32 and a bottom wall 33. The bottom wall 33 can be of a conventionally known type such as one that is similar to that disclose in U.S. Pat. No. 7,503,453 to CRONIN et al. In embodiments, however, it has the configuration shown in FIGS. 15-17, i.e., it has a generally tapered configuration so as to facilitate dispensing of the dispensable component under the force of gravity. The component holder 30 also can include struts or legs 34, e.g., four, which can be substantially equally spaced, which serve to define substantially equally sized openings 35 and to connect the bottom wall 33 to the cylindrical wall 40. The struts 34 can be of a conventionally known type such as ones that are similar to that disclose in U.S. Pat. No. 7,503,453 to CRONIN et al. In embodiments, however, they have the configuration shown in FIGS. 15-17, i.e., they have a generally tapered configuration so as to facilitate dispensing of the dispensable component under the force of gravity. The component holder 30 also can include a circumferential lower sealing projection 36 arranged at a lower end of the component holder 30. As discussed above, the sealing projection 36 is sized, shaped and configured to sealingly engage with the lower sealing recess 19 of the cap body 10. The component holder 30 further can include a circumferential upper sealing projection 37 arranged on the generally cylindrical wall 40 of the component holder 30. As discussed above, the sealing projection 37 is sized, shaped and configured to sealingly engage with the upper sealing recess 21 of the cap body 10 in the storage position and to lock with the recess 20 of the cap body 10 in the dispensing position. The component holder 30 also can include an inner space 38 sized, shaped and configured to receive therein the dispensable component(s) and optionally also air, gas or empty space. This space 38 extends axially from the bottom wall to the shoulder 47 and can also extend into an axial space within the cover 50, when installed. The component holder 30 also can include upper portion or region 39 which is sized, shaped or configured to project or extend above the main bore 11 of the cap body 10 in the storage position. The generally cylindrical wall 40 extends to an upper end 41 of the component holder 30. An inlet opening 42 is arranged in an area of the upper end 41 and is sized, shaped and configured to allow for the dispensable component(s) to pass into the space 38 and can receive therein and be closed-off by the cover 50. A circumferential sealing/locking recess 43 is formed in the inlet opening 42 and sized, shaped and configured to sealingly and lockingly engage with the circumferential sealing projection 56 of the cover 50. A dome-shaped outer portion 44 is also arranged in an area of the upper end 41 of the component holder 30. In embodiments, the portion 44 can be of an alternative shape such as e.g., flat or planar. A lower annular surface 45 is arranged at a lower end of the dome-shaped outer portion 44 and is sized, shaped or configured to contact, abut or be located adjacent to the surface 22 when the cap is in the dispensing position. This serves as an alternative or redundant mechanism to limit axial movement of the component holder 30 relative to the cap body 10. An annular space 46 is produced in the component holder 30 when the tear strip 60 is removed (see FIG. 23.

Figure 18:
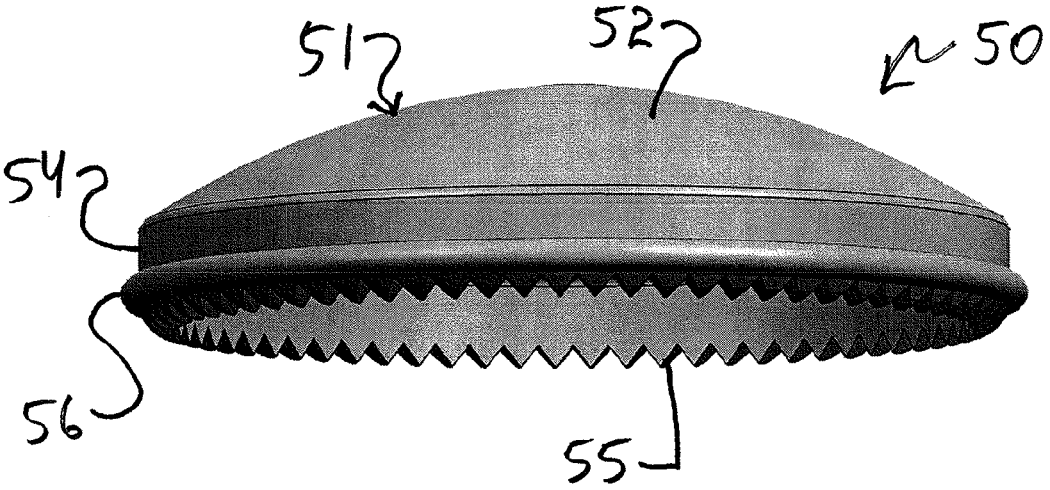
FIG. 18 shows an enlarged solid-shading side perspective view of the cover used in the cap shown in FIG. 6.

Referring now to FIG. 18, it can be seen that the cover 50 can be a one-piece integrally formed member that can include a generally dome-shaped wall 51 having a dome-shaped outer surface 52 as well as a dome-shaped inner surface 53 (see FIG. 11). In embodiments, the cover 50 can be of an alternative shape such as, e.g., inwardly curved, flat or planar. The cover 50 also can include a circumferential surface 54, a circumferential projection 56, and an annular surface 55 which can include, e.g., teeth, so as to, among other things, prevent rotation of the cover 50 when installed.

Figure 19:
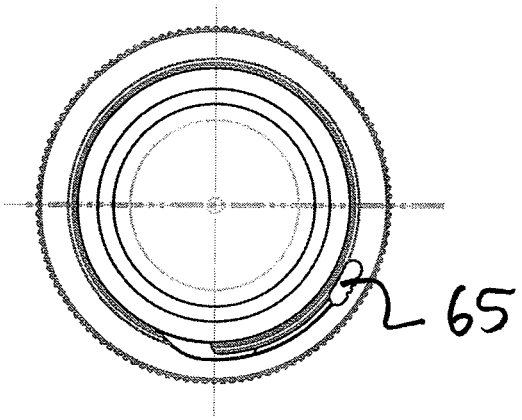
FIGS. 19-21 show top, cross-section and side views of the cap shown in FIG. 6, but with the cover shown in a position prior to being installed. Prior to installing the cover, the dispensable component can be placed into the space inside the component holder.
Figure 20:
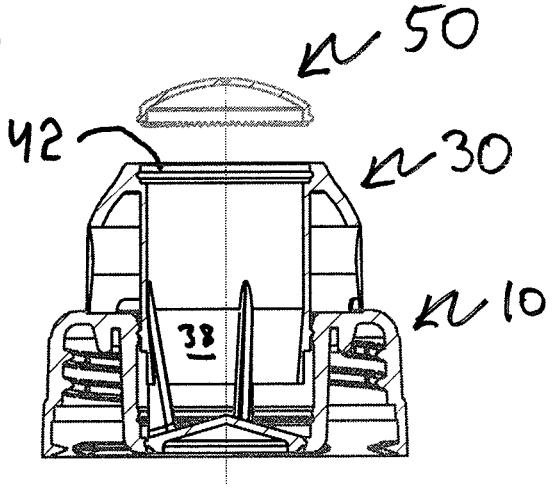
Figure 21:
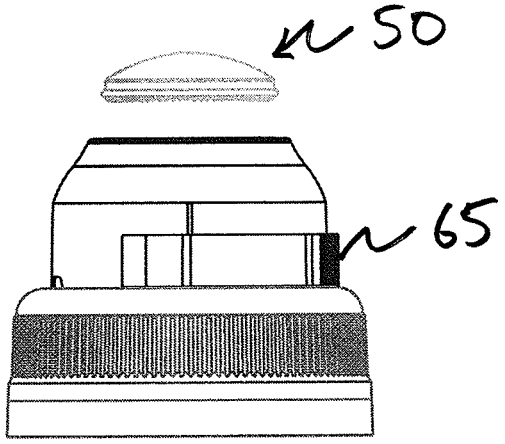

With reference to FIGS. 19-21, there can be seen one non-limiting way in which the cap 1 can be preassembled prior to receive therein a dispensable component(s). Prior to full assembly (and optionally even after being installed onto a container), the cap 1 can receive therein the dispensable component(s) via the opening 42. Once a desired amount of dispensable component(s) is placed in the space 38, the cover 50 can be installed on the cap 1 so that the cap assumes the configuration shown in FIG. 6 (the dispensable component(s) is not shown in FIG. 6 but its arrangement can be like that shown in FIG. 33). At this point, the cap 1 can be installed on a container.

Figure 1:
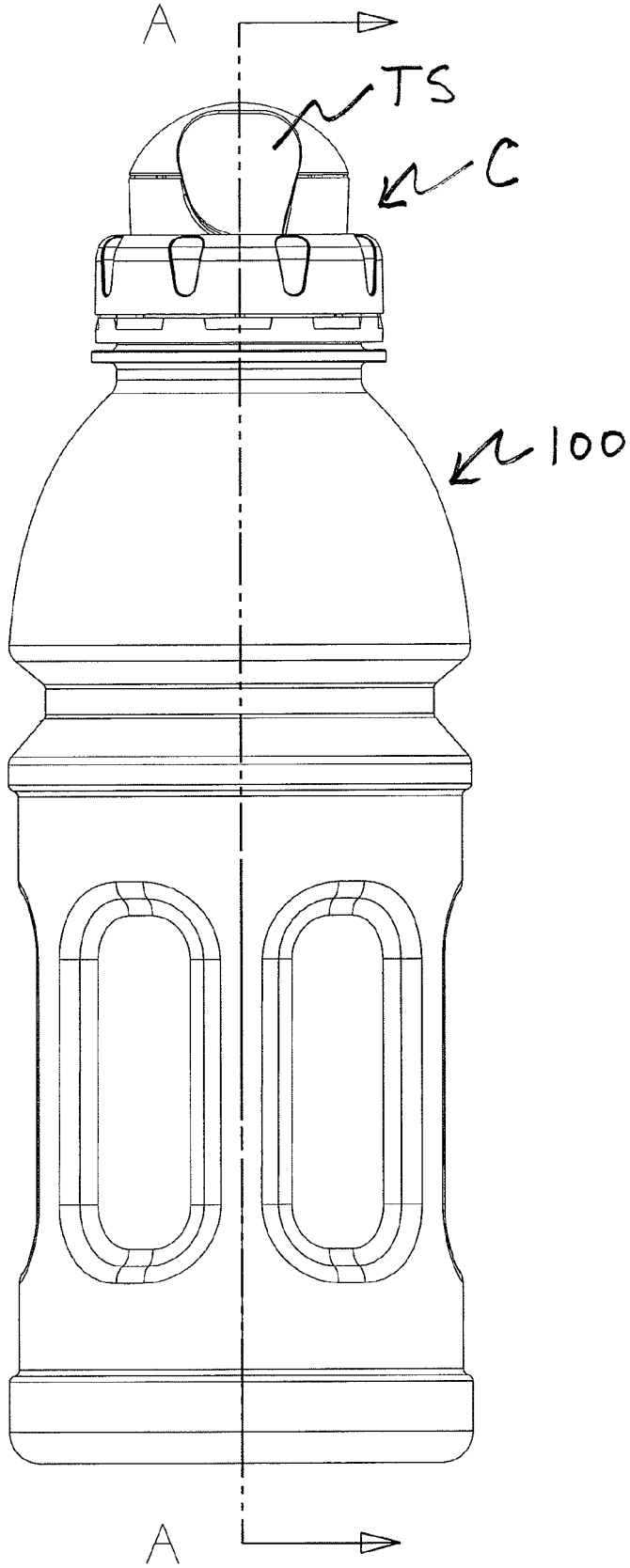
FIGS. 1-5 show various views of a conventional cap and container system in which the cap contains a component that can be dispensed into the container and thereby mix with another component in the container.
Figure 2:
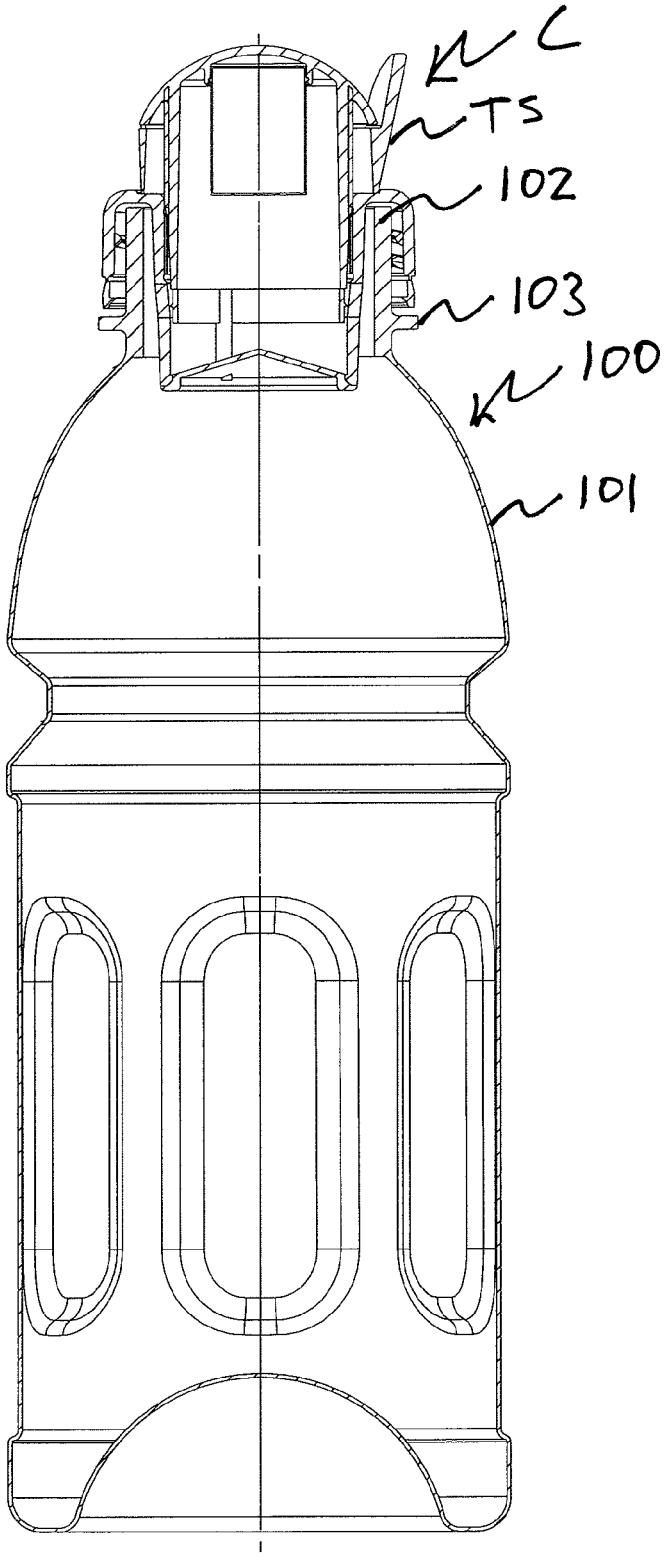
Figure 3:
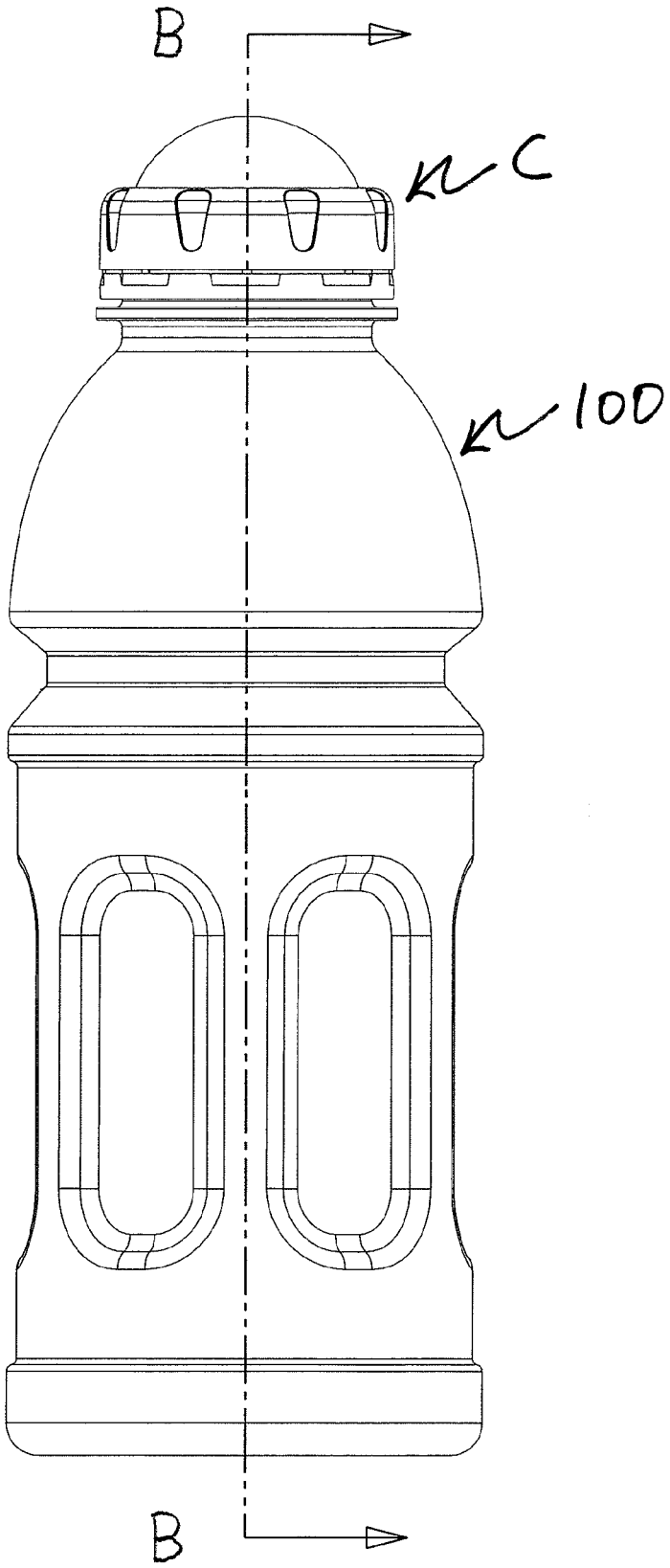
Figure 4:
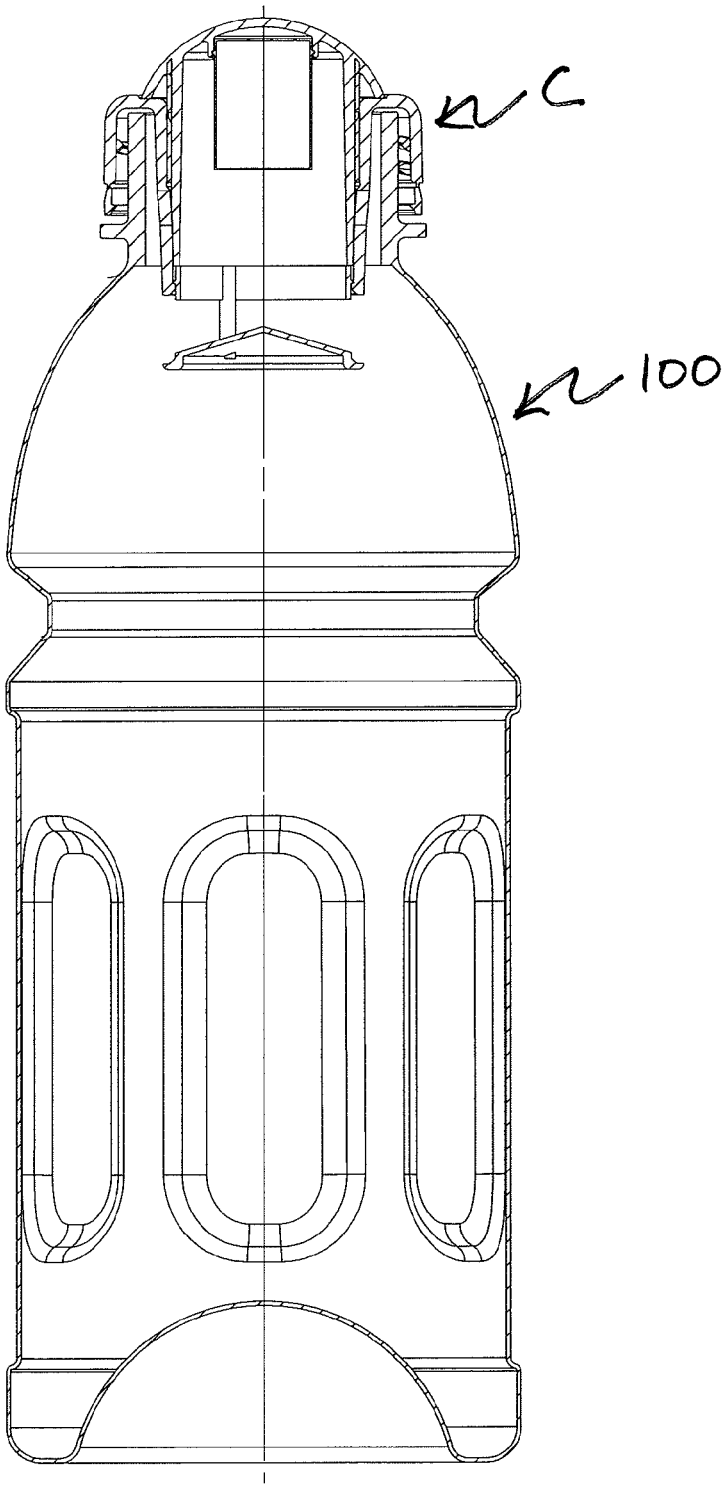

With reference to FIGS. 22-27, there can be seen one non-limiting way in which the cap 1 can be used to dispense a dispensable component(s)—after it is installed on a container in a manner similar to that shown in FIGS. 1 and 2. First, a user removes the tear strip 60 so that the cap 1 assumes the configuration shown in FIGS. 23 and 24. Then, the user moves the component holder 30 to the dispensing position shown in FIGS. 26 and 27 and similar to that shown in FIGS. 3 and 4. In this position, the dispensable component(s) stored in the cap 1 are allowed to pass out of the openings 35 and into the container.

Figure 29:
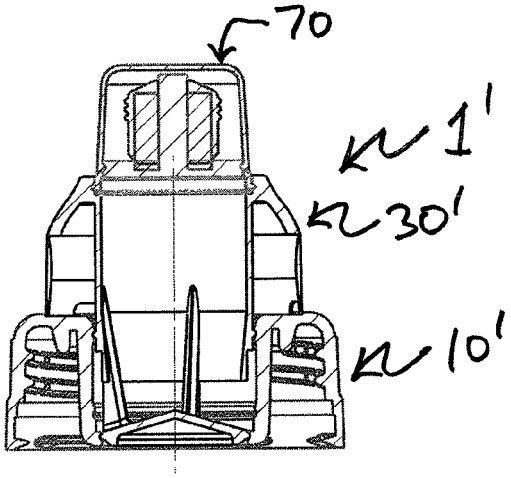
Figure 30:
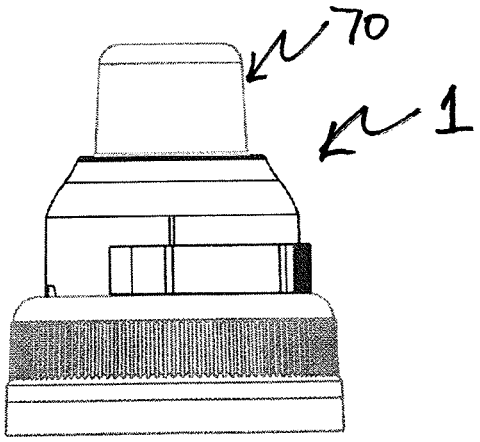
Figure 32:
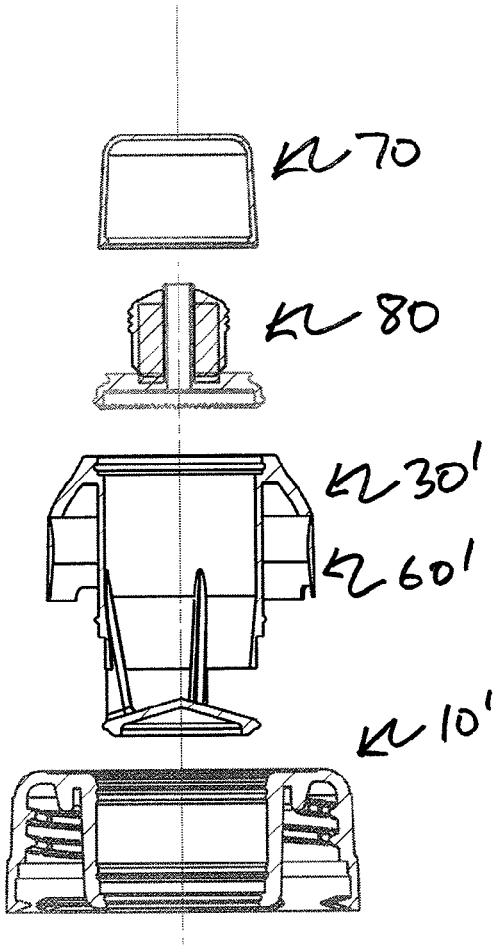
FIGS. 31 and 32 show side and cross-section views of the cap shown in FIGS. 28-30 in a disassembled state.
Figure 31:
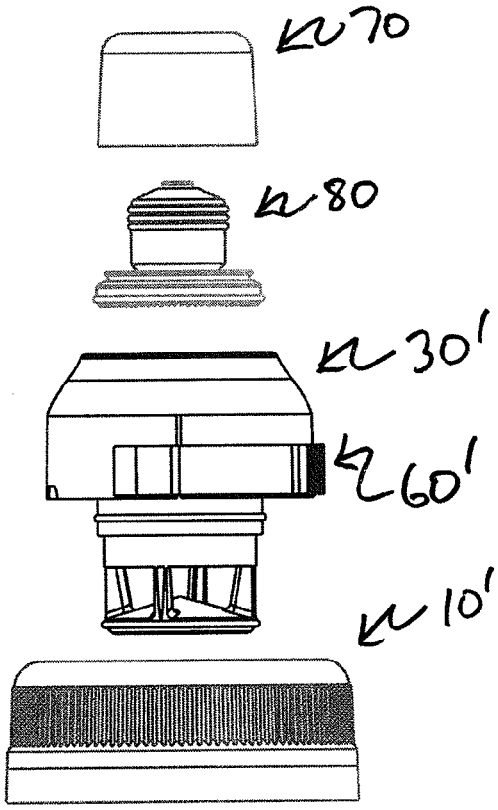

With reference to FIGS. 28-32, there is shown a second non-limiting embodiment of a cap or cap assembly 1'. As can be seen in FIG. 29, in embodiments, the cap 1' can include four main components, i.e., a cap body 10', a component holder 30', a nozzle arrangement 80, and a nozzle cap 70. The cap body 10', component holder 30' and tear strip 60' can be substantially similar to that of the first embodiment. However, the cover 50 is replaced with nozzle arrangement 80, which allows a user to sip contents of the container after the cap 1' is moved to the dispensing position. In embodiments, the nozzle 80 can even be replaced with any known drink through feature such as e.g., a baby bottle nipple or other device allowing the contents of the bottle or container to be dispensed. The nozzle 80 can be of a conventionally known type such as one that is similar to that disclosed in U.S. Pat. No. 7,503,453 to CRONIN et al. In embodiments, however, the nozzle 80 has the configuration shown in FIGS. 28-32, i.e., it has an outer member that can be moved from a closed position preventing sipping to an open position allowing sipping. The nozzle cap 70 can be of a conventionally known type such as one that is similar to that disclosed in U.S. Pat. No. 7,503,453 to CRONIN et al. In embodiments, however, the nozzle cap 70 has the configuration shown in FIGS. 28-32. The cap or over cap 70 can be a thin plastic snap fit cap that fits over a drink through spout feature and serves multiple functions including: protecting the drink through spout from tamper and contamination; providing a base surface for a heat shrink tamper evident over wrap or foil; providing a generally flat strike/press surface for the cap's mechanical actuation; and providing a rigid structure to divert top load off of and around the drink through spout feature.

Figure 33:
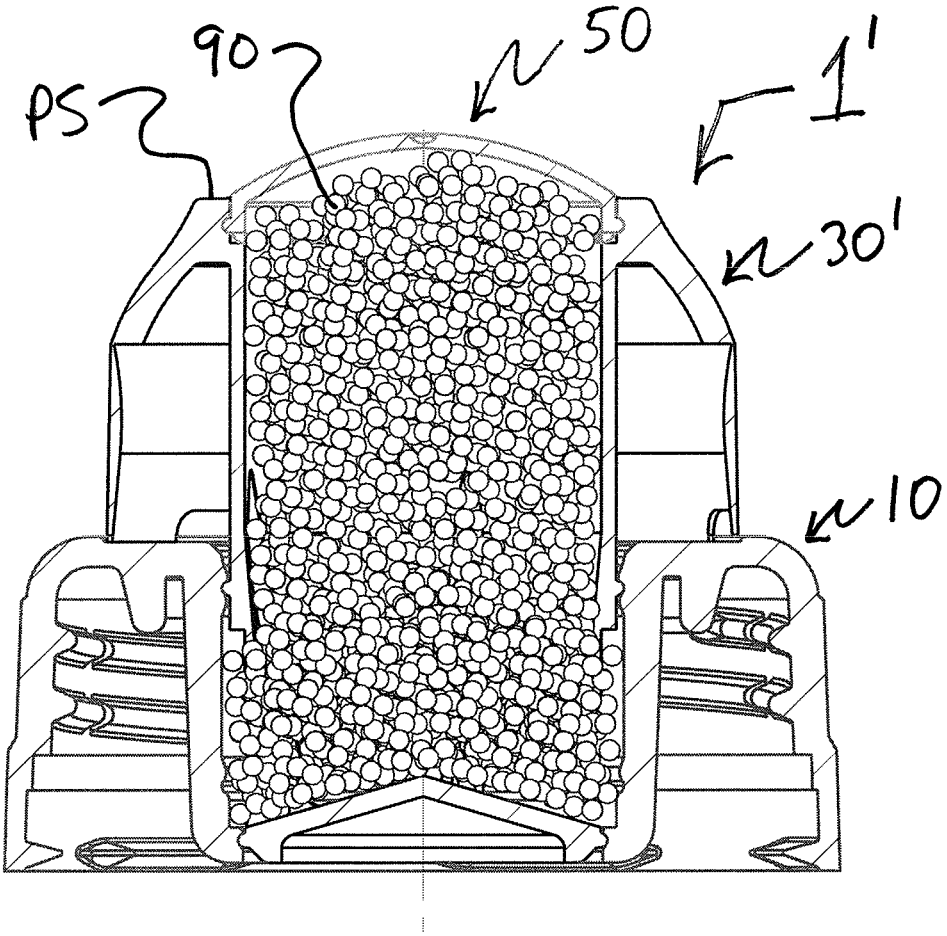
FIG. 33 shows an enlarged solid-shading cross-section of a cap or cap assembly in a fully assembled state in accordance with another embodiment of the invention. This embodiment is similar to that of FIG. 6 and shows one non-limiting way in which the dispensable component can be arranged within the component holder and cap and shows how the dispensable component can come into contact with portions or surfaces of the cover, component holder and the cap body.

With reference to FIG. 33, there is shown another non-limiting embodiment of a cap or cap assembly 1'. As can be seen in FIG. 33, in embodiments, the cap 1' can include three main components, i.e., a cap body 10, a component holder 30', and a cover 50. The cap body 10 installable or mountable to a container such a container 100 shown in FIGS. 1-4. Of course, containers of other types, sizes and shapes can be used with the cap 1 in accordance with the invention. The component holder 30' is similar to that of the previous embodiment, but is less dome-shaped and has generally planar surface PS. The cap 1' is otherwise substantially similar to that of the previous embodiment. Moreover, whereas one or more previous embodiments were disclosed and utilizing an empty space above the dispensable component 90, the instant embodiment shows one non-limiting way in which the dispensable component 90 can substantially fill an entire space within the cap 1' while also coming into contact with one or more portions and/or surfaces of each of the cap body 10, the component holder 30' and the cover 50.

In each of the herein disclosed embodiments, there can optionally be provided a mechanism for holding, retaining or storing a desicant similar to that disclosed in U.S. Pat. No. 7,503,453 to CRONIN et al. In embodiments, the cover 50 can include such a mechanism.

The following is an exemplary and/or non-limiting list of substances which can constitute a dispensable component usable with the cap of the invention: granules or tablets including Creatine, wolfberry, calcium, guanine, arginine, Vitamins B, B12, C, D, ibuprofen, electrolytes, niacin, folic acid, biotin, choline bitartate, inositol, manganese, calcium, Saint John's wart, yohimbe, chromium polynicotinate, carnitine, taurine, astragulus, schizandra, kava kava, lemon grass, Echinacea, prolione, bee pollen, amino acids, chitin oligomers, water soluble oral chitosan oligomers and zinc, among others. The component may comprise granules having different sizes and weights. For example, a first component, a supplemental component and a third component may be utilized. In an embodiment, the first component weighs approximately 0.10-0.50 grams, the supplemental component weighs approximately 0.15-0.75 grams and the third component weighs approximately 0.20-1.0 grams. In the stored condition, the dispensible component may be disbursed by weight/size within the chamber. In an alternate embodiment, the first, second and third components may be disbursed randomly throughout the chamber. It is also to be understood that in other embodiments the chamber may include a single component having one size and shape, two components having two sizes and shapes or any number or combination of components having different sizes and shapes. In a further alternate embodiment, the component in a second chamber may be a powder, liquid, gas, slurry or other particles.

The following is a list of materials which can be used to form the container as well as the cap body 10, the component holder 30, the cover 50, and/or the tear strip 60: these components may be formed or manufactured by any known methods in the art. For example, the container or bottle may be blow molded. The cap components may be injection molded. One, many, most or all parts may be made of FDA approved materials. Materials may include Low Density Polyethylene (LDPE), High Density Polyethylene (HDPE), Polypropylene (PP), Rigid Polyvinyl Chloride (PVC), Polyester and Co-Polyester (PET and PET-G), Styrene Acrylonitrile (SAN), Polystyrene (PS).

EXAMPLES OF NON-LIMITING EMBODIMENTS

Example A

With reference to the Figures, in embodiments, there is provided a cap 1 comprising a cap body 10 mountable to a container 100 and a main bore 11 disposed in the cap body 10. A movable component holder 30 comprises a lower end 32 an upper end 41, and a space 38 sized and configured to contain a dispensable component 90 (e.g., in a way similar to that shown in FIG. 33). A cover 50 is installable on the upper end 41 of the component holder 30. A removable strip 60 at least one of is arranged between a portion 45 of the upper end 41 of the component holder 30 and an upper surface 22 of the cap body 10, has an upper end 62 removably connected to a portion 45 of the upper end 41 of the component holder 30, has a lower end 64 contacting or arranged adjacent a portion 22 of the cap body 10, and/or is integrally formed with the upper end 41 of the component holder 30. When the component holder 30 is in an initial or retracted position (FIGS. 6 and 24), a portion 17/33/34/53 of each of the cap body 10, the component holder 30, and the cover 50 is adapted to come into contact with the dispensable component 90. Also, when the cap 1 is arranged on the container 100 and the component holder 30 is arranged in a dispensing position (FIGS. 26 and 27), the dispensable component 90 can pass into the container 100 through a portion 35 of the component holder 30 disposed between the lower end 32 and a portion 24 of the cap body 10.

In additional embodiments, the cover 50 at least one of is non-removably connected (via projection 56 and recess 43) to the upper end 41 of the component holder 30, closes off an opening 42 in the upper end 41 which allows the dispensable component 90 to pass into the space 38, and/or is generally dome-shaped 51.

In alternative or additional embodiments, the cap 1 may further comprises a first seal 36 arranged in an area 31 of the lower end 32 of the component holder 30 and is in a sealing position (i.e., sealing with sealing recess 19) when the component holder 30 is in the initial or retracted position (FIGS. 6 and 24) and a second seal 37 arranged on the component holder 30 and is axially spaced from the first seal 36.

Figure 22:
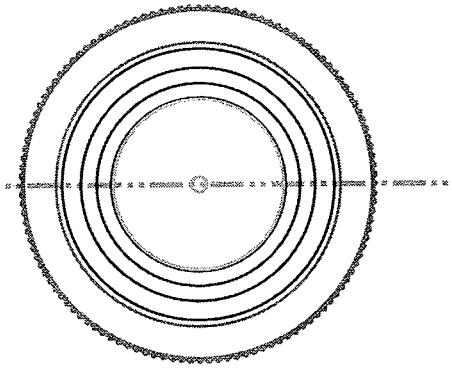
FIGS. 22-24 show top, cross-section and side views of the cap shown in FIG. 6, but with the tear strip removed thereby exposing an annular space which will allow for axial movement of the component holder relative to the cap body when the cap is placed in the activated or dispensing position.
Figure 23:
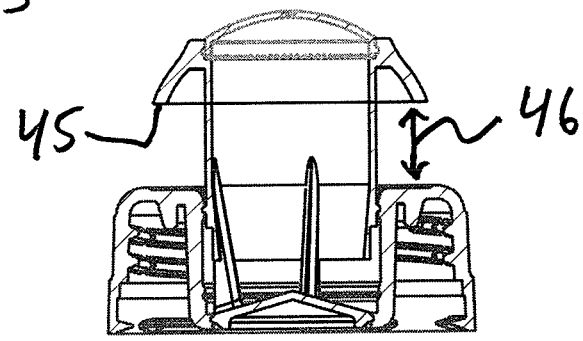
Figure 24:
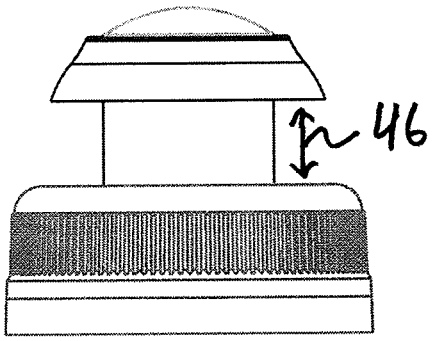
Figure 25:
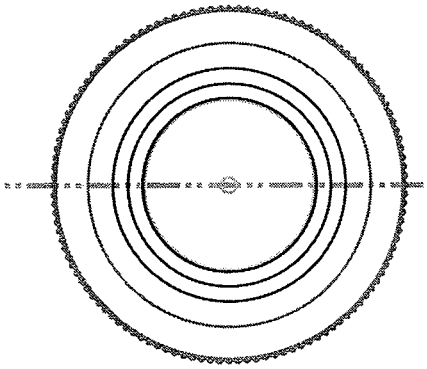
FIGS. 25-27 show top, cross-section and side views of the cap shown in FIG. 6 after it has been placed in the activated or dispensing position.

In alternative or additional embodiments, the first and second seals 36 and 37 are in sealing engagement with different portions 19 and 21 of the cap body 10 when the component holder 30 is in the initial or retracted position (FIGS. 6 and 22).

Figure 26:
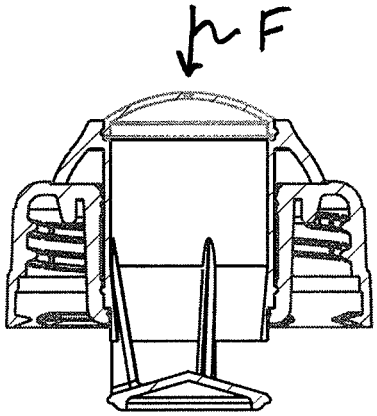
Figure 27:
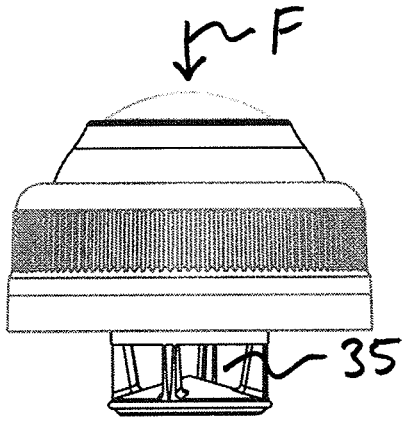
Figure 28:
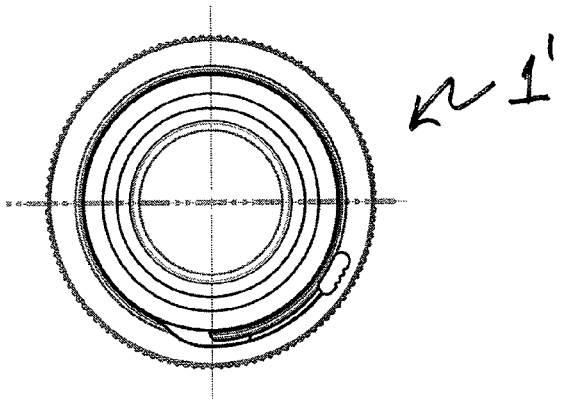
FIGS. 28-30 show top, cross-section and side views of a cap or cap assembly in accordance with another embodiment of the invention. The cap is similar to that shown in FIG. 6 except that the cover is replaced with a cover having a nozzle system and nozzle cover.

In alternative or additional embodiments, the second seal 37 is in a locking engagement via locking recess 20 when the component holder 30 is in the dispensing position (FIGS. 26 and 27).

In alternative or additional embodiments, the component holder 30 and the removable strip 60 are formed as a one-piece member.

In alternative or additional embodiments, at least one of; the cap body 10 is a one-piece member and the cover 50 is a one-piece member, and/or the cap body 10 has an axial length that is shorter than a diameter of an outer most surface (of wall 16) and the cover 50 is generally dome-shaped 51.

In alternative or additional embodiments, the removable strip 60 at least one of is a tear strip (via frangible connection 63), prevents movement of the component holder 30 from the initial or retracted position (FIGS. 6 and 24) to the dispending position (FIGS. 26 and 27) until the removable strip 60 is removed (FIGS. 23 and 24), and/or is a generally cylindrical strip-shaped member 61 having a pull-tab 65 and being connected with a frangible or breakable connection 63 to the upper end 41 of the component holder 30.

In alternative or additional embodiments, the lower end 32 comprises one of a tapered bottom 33, a conical shaped bottom wall 33, and a bottom wall 33 having a shape configured to facilitate a flowing out of the dispensable component 90 when the component holder 90 is arranged in the dispensing position (FIGS. 26 and 27).

In alternative or additional embodiments, the cap 1 may further comprise at least one of; legs 34 connecting a bottom wall 33 to a main body portion 40 of the component holder 30, openings 35 disposed between legs 34 allowing the dispensable component 90 to pass out of the space 38, and openings 35 and legs 34 axially arranged between first and second axially spaced seals 36 and 37 of the component holder 30.

In alternative or additional embodiments, the original or retracted position (FIGS. 6 and 24) is a releasably lockable (via projections 36 and 37 engaging recesses 19 and 21) storage position (FIGS. 6 and 24) and the dispensing position (FIGS. 26 and 27) is a lockable (via projection 37 and recess 20) activated position.

In alternative or additional embodiments, the cover 50 is at least one of structured and arranged to receive a desiccant 70, press fit (via projection 56 and recess 43) attached to the upper end 41 of the component holder 30, and in sealing engagement (via surfaces 54 and/or 55 and opening 42 and/or projection 56 and recess 43) with the upper end 41 of the component holder 30.

In alternative or additional embodiments, in the dispensing position (FIGS. 26 and 27), the cap body 10, the component holder 30 and the cover 50 comprise an integral unit.

In alternative or additional embodiments, the main bore 11 of the cap body 10 is defined by a generally cylindrical inner wall 17, and the cap body 10 further comprises at least one of an outer wall 16 surrounding the inner wall 17 and having an internal thread or thread segments 15 arranged on an inner surface of the outer wall 16 and a tamper-evident ring 13 connected (via frangible connection 14) to the cap body 10.

In alternative or additional embodiments, the upper end 41 comprises one of a center opening 42 sized to receive therein the cover 50, an outermost diameter that is larger than a diameter of an inner wall 17 of the cap body 10 and smaller than a diameter of an outer wall 16 of the cap body 10, a generally dome-shaped annular portion 44 of the component holder 30, a lower surface 45 axially spaced above an upper surface 22 of the cap body 10 when the component holder 30 is in the initial or retracted position (FIGS. 6 and 24), and a lower surface 45 axially arranged adjacent an upper surface 22 of the cap body 10 when the component holder 30 is in the dispensing position (FIGS. 26 and 27).

In alternative or additional embodiments, the space 38 is at least one of a generally cylindrical space, axially disposed between the cover 50 and the lower end 32 of the component holder 30, and sized and configured to contain a predetermined amount of dispensable component 90 and a predetermined amount of empty space, gas or air G.

Example B

In embodiments, there is provided a method of assembling the cap 1 of any of the types described herein wherein the method comprises inserting the component holder 30, lower end 32 first, into the main bore 11 of the cap body 10 as shown in FIGS. 11 and 6. After the inserting, placing a measured amount of the dispensable component 90 into the space 38, and attaching the cover 50 to the upper end 41 of the component holder 30 as shown in FIGS. 20 and 21.

In alternative additional embodiments, the method further comprises mounting, screwing or threading the cap 1 onto a container 100, i.e., onto the rim opening portion 102, until a tamper evident ring 13 locks behind a collar 103 of the container 100.

Example C

In embodiments, there is provided, in combination, the cap 1 having one or more features disclosed herein (see FIGS. 6-33) and at least one of a container 100, a single wall, i.e., the single walled body 101, container 100, and a container 130 containing a component 95 different from the dispensable component(s) 90.

Example D

In embodiments, the cap 1 has one or more features disclosed herein (see FIGS. 6-33) and contains therein a dispensable component(s) 90.

Example E

In embodiments, there is provided a method of using the cap 1 of any of the types described herein (see FIGS. 6-33), wherein the method comprises removing the removable strip 60 with the cap installed on a container 100 and applying a force F to the upper end 41 of the component holder 30 sufficient to cause the component holder 30 to move from the initial or retracted position (FIG. 6 or 24) to the dispensing position (FIGS. 26 and 27). In the dispensing position (FIGS. 26 and 27), at least one of; substantially all of the dispensable component 90 passes into the container 100, substantially all of the dispensable component 90 automatically passes into the container 100, and substantially all of the dispensable component 90 passes into the container 100 under the influence of gravity.

Example F

According to one non-limiting aspect of the invention, there is provided a cap 1 comprising a cap body 10 mountable to a container 100 and comprising a bore 11. A component holder 30 comprises an upper portion 39, an internal space 38 for accommodating a dispensable component 90, a lower portion 31, and a bottom wall 33. The lower portion 31 is positionable inside the bore 11 and comprises first and second axially spaced seals 36 and 37 and at least one opening 35 arranged between the first and second axially spaced seals 36 and 37. The upper portion 39 comprises at least a partially dome-shaped surface 44 and an opening 42 allowing the dispensable component 90 to enter into the space 38. A removable tear strip 60 at least one of structured and arranged to prevent the component holder 30 from moving downward relative to the cap body 10 until the tear strip 60 is removed (see FIGS. 26 and 27) and provides a compression barrier (i.e., resists force F) against activation of the cap 1. In a storage position (FIGS. 6 and 24), a portion 17/33/34 of each of the cap body 10 and the component holder 30 is adapted to come into contact with a dispensable component 90. Also, when the cap 1 is arranged on the container 100 and the component holder 30 is moved to an activated position (FIGS. 26 and 27), the dispensable component 90 can pass into the container 100 through the at least one opening 35 formed in the lower portion 31 of the component holder 30.

In alternative or additional embodiments, the cap 1 may further comprise a cover 50 sized to close off the opening 42 of the upper portion 39, wherein the internal space 38 is arranged between the bottom wall 33 and the cover 50.

In alternative or additional embodiments, the internal space 38 may be a generally cylindrical internal space.

In alternative or additional embodiments, at least one of; (a) in the activated or dispensing position (FIGS. 26 and 27), the second seal 36 is separated from a lower end 24 of an inner wall 17 of the cap body 10 and the first seal 37 is in locking engagement with a locking seal 19 arranged on the inner wall 17 and (b) in the storage position (FIGS. 6 and 24), the second seal 36 is in sealing engagement with a lower portion 19 of an inner wall 17 of the cap body 10 and the first seal 37 is in sealing engagement with an upper portion 21 of the inner wall 17.

In alternative or additional embodiments, the cap 1 further comprises a cover 50 having a generally dome-shaped outer surface 52.

In alternative or additional embodiments, the storage position (FIGS. 6 and 26) is a lockable (via projections 36 and 37 engaging recesses 19 and 21) storage position and the activated position (FIGS. 26 and 27) is a lockable (via projection 37 and recess 20) activated position.

In alternative or additional embodiments, the cap 1 may further comprise at least one of (a) struts 34 are arranged on the component holder 30 between the first and second seals 36 and 37 and (b) the at least one opening 35 comprises apertures 35 disposed between struts 34.

Example G

According to one non-limiting aspect of the invention, there is provided a cap 1 comprising a cap body 10 mountable to a container 100 and comprising a bore 11. A movable component holder 30 comprises a lower end 32, an upper end 41, a space 38 sized to contain a dispensable component 90, and an axial length greater than an axial length of the cap body 10. First and second axially spaced seals 37 and 36 are arranged on the component holder 30. The first seal 37 is arranged on the lower region 31 of the component holder 30 and is in sealing engagement with a first portion 21 of an inner wall 17 of the cap body 10. The second seal 37 is arranged on the lower region 31 of the component holder 30 and is in sealing engagement with a second axially lower portion 19 of the inner wall 17 of the cap body 10. A generally dome-shaped cover 50 is in sealing engagement (via element 56) with a portion 43 of the upper end 41 of the component holder 30. When the component holder 30 is in an original or retracted position (FIGS. 6 and 24), a portion of each of the cap body 10, the component holder 30, and the cover 50 is adapted to come into contact with the dispensable component 90. Also, when the cap 1 is arranged on the container 100 and the component holder 30 is in a dispensing position (FIGS. 26 and 27), the dispensable component 90 can pass into the container 100 through a portion 35 of the component holder 30 disposed between the first and second seals 36 and 37.

Example H

In alternative or additional embodiments, any of the herein disclosed caps 1 may further comprise at least one of a sipper 80 arranged on the upper end 41 of the component holder 30, a nozzle or sipper 80 coupled to the cover 50, and a cover 50 comprising a nozzle or sipper portion 80.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A cap comprising:

a cap body mountable to a container;

a main bore disposed in the cap body;

a movable component holder comprising a lower end, an upper end, and a space sized and configured to contain a dispensable component;

a cover installable on the upper end of the component holder, a removable strip that at least one of:

is arranged between a portion of the upper end of the component holder and an upper surface of the cap body;

has an upper end removably connected to a portion of the upper end of the component holder;

has a lower end contacting or arranged adjacent a portion of the cap body; and is integrally formed with the upper end of the component holder, wherein, when the cover is installed and the component holder is in an initial or retracted position, a portion of each of the cap body, the component holder, and the cover is adapted to come into contact with the dispensable component, and wherein, when the cap is arranged on the container and the component holder is arranged in a dispensing position, the dispensable component can pass into the container through a portion of the component holder disposed between the lower end of the component holder and a portion of the cap body.

2. The cap of claim 1, wherein the cover is at least one of:

non-removably installed on the upper end of the component holder;

arranged to close off an opening in the upper end which allows the dispensable component to pass into the space; and generally dome-shaped.

3. The cap of claim 1, further comprising:

a first seal arranged in an area of the lower end of the component holder and being in a sealing position when the component holder is in the initial or retracted position; and a second seal arranged on the component holder and being axially spaced from the first seal.

4. The cap of claim 3, wherein the first and second seals are in sealing engagement with different portions of the cap body when the component holder is in the initial or retracted position.

5. The cap of claim 4, wherein the second seal is in a locking engagement when the component holder is in the dispensing position.

6. The cap of claim 4, wherein the component holder and the removable strip are formed as a one-piece member.

7. The cap of claim 1, wherein at least one of:
the cap body is a one-piece member and the cover is a one-piece member; and
the cap body has an axial length that is shorter than a diameter of an outer most surface and the cover is generally dome-shaped.

8. The cap of claim 1, wherein the removable strip at least one of:
is a tear strip;
prevents movement of the component holder from the initial or retracted position to the dispending position until the removable strip is removed; and
is a generally cylindrical strip-shaped member having a pull-tab and being connected with a frangible or breakable connection to the upper end of the component holder.

9. The cap of claim 1, wherein the lower end comprises one of:
a tapered bottom;
a conical shaped bottom wall; and
a bottom wall having a shape configured to facilitate a flowing out of the dispensable component when the Component holder is arranged in the dispensing position.

10. The cap of claim 1, further comprising at least one of:
legs connecting a bottom wall to a main body portion of the component holder;
openings disposed between legs allowing the dispensable component to pass out of the space;
openings and legs disposed between first and second axially spaced sealing portions; and
openings and legs axially arranged between first and second axially spaced seals of the component holder.

11. The cap of claim 1, wherein the initial or retracted position is a releasably lockable storage position and the dispensing position is a lockable activated position.

12. The cap of claim 1, wherein the cover is at least one of:
structured and arranged to receive a desiccant;
press fit attached to the upper end of the component holder; and
in sealing engagement with the upper end of the component holder.

13. The cap of claim 1, wherein, in the dispensing position, the cap body, the component holder and the cover comprise an integral unit.

14. The cap of claim 1, wherein the main bore of the cap body is defined by a generally cylindrical inner wall, and wherein the cap body further comprises at least one of:
an outer wall surrounding the inner wall and having an internal thread or thread segments arranged on an inner surface of the outer wall; and
a tamper-evident ring connected to the cap body.

15. The cap of claim 1, wherein the upper end comprises one of:
a center opening sized to receive therein the cover;
an outermost diameter that is larger than a diameter of an inner wall of the cap body and smaller than a diameter of an outer wall of the cap body;
a generally dome-shaped annular portion of the component holder;
a lower surface axially spaced above an upper surface of the cap body when the component holder is in the initial or retracted position; and
a lower surface axially arranged adjacent an upper surface of the cap body when the component holder is in the dispensing position.

16. The cap of claim 1, wherein the space is at least one of:
a generally cylindrical space;
axially disposed between the cover and the lower end of the component holder; and
sized and configured to contain a predetermined amount of dispensable component and a predetermined amount of gas or air.

17. A method of assembling the cap of claim 1, the method comprising:
inserting the component holder, lower end first, into the main bore of the cap body;
after the inserting, placing a measured amount of the dispensable component into the space; and
attaching the cover to the upper end of the component holder.

18. The method of claim 17, further comprising mounting the cap onto a container until a tamper evident ring locks behind a collar of the container.

19. In combination, the cap according to claim 1 with at least one of:
a container;
a single wall container; and
a container contains a component different from the dispensable component.

20. In combination, the cap according to claim 1 and containing therein a dispensable component.

21. A method of using the cap of claim 1, the method comprising:
removing the removable strip with the cap installed on a container; and
applying a force to the upper end of the component holder sufficient to cause the component holder to move from the initial or retracted position to the dispensing position,
wherein, in the dispensing position, at least one of:
substantially all of the dispensable component passes into the container;
substantially all of the dispensable component automatically passes into the container; and
substantially all of the dispensable component passes into the container under the influence of gravity.

22. A cap comprising:
a cap body mountable to a container and comprising a bore;
a component holder comprising an upper portion, an internal space for accommodating a dispensable component, a lower portion, and a bottom wall;
the lower portion being positionable inside the bore and comprising:
first and second axially spaced seals; and
at least one opening arranged between the first and second axially spaced seals;
the upper portion comprising at least a partially dome-shaped surface and an opening allowing the dispensable component to enter into the space; and
a removable tear strip at least one of:
being structured and arranged to prevent the component holder from moving downward relative to the cap body until the tear strip is removed; and
providing a compression barrier against activation of the cap,
wherein, in a storage position, a portion of each of the cap body and the component holder is adapted to come into contact with a dispensable component, and
wherein, when the cap is arranged on the container and the component holder is moved to an activated position, the dispensable component can pass into the container through the at least one opening formed in the lower portion of the component holder.

23. The cap of claim 22, further comprising a cover sized to close off the opening of the upper portion, wherein the internal space is arranged between the bottom wall and the cover.

24. The cap of claim 22, wherein the internal space is a generally cylindrical internal space.

25. The cap of claim 22, wherein at least one of;

in the activated position, the second seal is separated from a lower end of an inner wall of the cap body and the first seal is in locking engagement with a locking seal arranged on the inner wall; and in the storage position, the second seal is in sealing engagement with a lower portion of an inner wall of the cap body and the first seal is in sealing engagement with an upper portion of the inner wall.

26. The cap of claim 22, further comprising a cover having a generally dome-shaped outer surface.

27. The cap of claim 22, wherein the storage position is a lockable storage position and the activated position is a lockable activated position.

28. The cap of claim 22, further comprising at least one of:

struts arranged on the lower end of the component holder between the first and second seals; and the at least one opening comprises apertures disposed between struts.

29. A cap comprising:

a cap body mountable to a container and comprising a bore;

a movable component holder comprising a lower end, an upper end, a space sized to contain a dispensable component, and an axial length greater than an axial length of the cap body;

first and second axially spaced seals arranged on the component holder;

the first seal arranged on a lower region of the component holder and being in sealing engagement with a first portion of an inner wall of the cap body;

the second seal arranged on the lower region of the component holder and being in sealing engagement with a second axially lower portion of the inner wall of the cap body;

a generally dome-shaped cover in sealing engagement with a portion of the upper end of the component holder, wherein, when the component holder is in an original or retracted position, a portion of each of the cap body, the component holder, and the cover is adapted to come into contact with the dispensable component, and wherein, when the cap is arranged on the container and the component holder is in a dispensing position, the dispensable component can pass into the container through a portion of the lower region disposed between the first and second seals.

30. The cap of claim 29, further comprising at least one of:

a sipper arranged on the upper end of the component holder;

a nozzle or sipper coupled to the cover;

a cover comprising a nozzle or sipper portion;

a combination of an outer cover and a nozzle or sipper; and a drink through feature.

* * * * *